US010731647B2

(12) United States Patent
Lee et al.

(10) Patent No.: US 10,731,647 B2
(45) Date of Patent: Aug. 4, 2020

(54) HIGH PRESSURE COMPRESSOR AND REFRIGERATING MACHINE HAVING A HIGH PRESSURE COMPRESSOR

(71) Applicant: LG ELECTRONICS INC., Seoul (KR)

(72) Inventors: Jingyu Lee, Seoul (KR); Jeonghyeon Park, Seoul (KR); Yeongcheol Ko, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 432 days.

(21) Appl. No.: 15/345,561

(22) Filed: Nov. 8, 2016

(65) Prior Publication Data

US 2017/0248356 A1 Aug. 31, 2017

Related U.S. Application Data

(63) Continuation-in-part of application No. 15/212,416, filed on Jul. 18, 2016, now Pat. No. 10,309,700.

(30) Foreign Application Priority Data

Feb. 26, 2016 (KR) ..... 10-2016-0023483

(51) Int. Cl.
*F04C 28/06* (2006.01)
*F25B 49/02* (2006.01)
(Continued)

(52) U.S. Cl.
CPC ..... *F04C 28/06* (2013.01); *F04B 49/06* (2013.01); *F04C 18/3564* (2013.01);
(Continued)

(58) Field of Classification Search
CPC ..... F04B 49/02; F04B 49/03; F04B 49/035; F04B 49/06; F04B 49/065; F04B 49/22;
(Continued)

(56) References Cited

U.S. PATENT DOCUMENTS 4,135,860 A * 1/1979 van Nederkassel .. F04B 49/022 417/12
5,674,058 A * 10/1997 Matsuda ..... F04C 28/16 417/440
(Continued)

FOREIGN PATENT DOCUMENTS

CN 1266947 9/2000
CN 1690417 11/2005
(Continued)

OTHER PUBLICATIONS

U.S. Office Action issued in U.S. Appl. No. 15/212,416 dated Jul. 10, 2018.
(Continued)

*Primary Examiner* — Bryan M Lettman
*Assistant Examiner* — Charles W Nichols
(74) *Attorney, Agent, or Firm* — KED & Associates LLP

(57) ABSTRACT

A high pressure compressor according to the present disclosure and a refrigerating cycle device to which the high pressure compressor is applied may include a casing having a sealed inner space; drive motor provided in the inner space of the casing; a compression unit provided in the inner space of the casing, and provided with a compression space for compressing refrigerant, and provided with a suction port for guiding refrigerant into the compression space, and provided with a discharge port for guiding refrigerant compressed in the compression space into the inner space of the casing a discharge valve provided in the compression unit to selectively open or close the discharge port according to a difference between a pressure of the inner space of the casing and a pressure of the compression space of the compression unit; a first valve configured to suppress refrigerant discharged from the inner space of the casing from flowing backward into the inner space of the casing; a bypass pipe connected between a discharge side and a
(Continued)

suction side of the compression unit based on the compression unit; and a second valve provided at the bypass pipe to selectively open or close the bypass pipe.

11 Claims, 19 Drawing Sheets

(51) Int. Cl.

| | |
|---|---|
| ***F04C 28/26*** | (2006.01) |
| ***F25B 31/02*** | (2006.01) |
| ***F04C 23/00*** | (2006.01) |
| ***F04C 18/356*** | (2006.01) |
| ***F04C 29/12*** | (2006.01) |
| ***F04B 49/06*** | (2006.01) |

(52) U.S. Cl.
CPC ..... *F04C 23/008* (2013.01); *F04C 28/26* (2013.01); *F04C 29/126* (2013.01); *F25B 31/026* (2013.01); *F25B 49/022* (2013.01); *F04C 2240/804* (2013.01); *F04C 2240/811* (2013.01); *F25B 2500/26* (2013.01); *F25B 2500/27* (2013.01); *F25B 2600/0261* (2013.01)

(58) Field of Classification Search
CPC ..... F04B 49/24; F04B 49/243; F04B 49/246; F04B 2205/07; F04B 2205/16; F04C 14/24; F04C 14/26; F04C 14/265; F04C 23/008; F04C 28/06; F04C 28/065; F04C 28/24; F04C 28/26; F04C 28/265; F04C 29/0085; F04C 2210/26; F04C 2240/40; F04C 2240/806; F04C 2270/40; F04C 2270/58; F04C 2270/585; F04C 2270/60; F04C 2270/605; F25B 41/04; F25B 49/022; F25B 49/025; F25B 2500/26; F25B 2500/27; F25B 2600/2501
See application file for complete search history.

(56) References Cited

U.S. PATENT DOCUMENTS

| | | | | |
|---|---|---|---|---|
| 6,085,533 | A | 7/2000 | Kaido et al. | |
| 7,721,757 | B2 | 5/2010 | Ginies et al. | |
| 2001/0014289 | A1 | 8/2001 | Murakami | |
| 2002/0020183 | A1 | 2/2002 | Hayashi | |
| 2002/0036438 | A1 | 3/2002 | Nishiyama | |
| 2002/0078697 | A1 | 6/2002 | Lifson | |
| 2009/0217679 | A1 | 9/2009 | Raghavachari | |
| 2012/0107163 | A1* | 5/2012 | Monnier | F04C 18/0215 418/1 |
| 2014/0020411 | A1 | 1/2014 | Li | |
| 2014/0099218 | A1* | 4/2014 | Hiwata | F04C 29/12 417/410.3 |
| 2014/0182312 | A1* | 7/2014 | Lundberg | F25B 45/00 62/56 |

FOREIGN PATENT DOCUMENTS

| | | |
|---|---|---|
| CN | 1699755 | 11/2005 |
| CN | 103511261 | 1/2014 |
| CN | 203785237 | 8/2014 |
| CN | 203962412 | 11/2014 |
| DE | 1163863 | 2/1964 |
| EP | 1589302 | 10/2005 |
| EP | 1 598 616 | 11/2005 |
| EP | 1 738 119 | 1/2007 |
| JP | 1983-079586 | 5/1983 |
| JP | 1984-484064 | 12/1984 |
| JP | 1988-140885 | 6/1988 |
| JP | 1995-247981 | 9/1995 |
| JP | 2000-205137 | 7/2000 |
| JP | 2002-250292 | 9/2002 |
| JP | 2003-314911 | 11/2003 |
| JP | 2003-314912 | 11/2003 |
| JP | 2004-218455 | 8/2004 |
| JP | 2008-509325 | 3/2008 |
| JP | 2014-185565 | 10/2014 |
| JP | 2016-020657 | 2/2016 |
| KR | 20-1995-0033637 | 12/1995 |
| KR | 10-2005-0102528 | 10/2005 |
| KR | 10-2006-0026812 | 3/2006 |
| WO | WO 2005/088212 | 9/2005 |

OTHER PUBLICATIONS

European Office Action dated Jan. 24, 2018.
Japanese Office Action dated Jan. 30, 2018.
Japanese Office Action dated May 30, 2017 issued in Application No. 2016-141960.
Chinese Office Action dated Jun. 5, 2018 (English Translation).
Korean Office Action dated Nov. 9, 2016 issued in Application No. 10-2016-0023483.
Taiwanese Office Action dated Sep. 13, 2017. (English Translation).
U.S. Appl. No. 15/212,416, filed Jul. 18, 2016.
European Search Report dated Mar. 31, 2017 issued in Application No. 16 189 734.3.

* cited by examiner

HIGH PRESSURE COMPRESSOR AND REFRIGERATING MACHINE HAVING A HIGH PRESSURE COMPRESSOR

CROSS-REFERENCE TO RELATED APPLICATION(S)

This application is a Continuation-in-part of copending U.S. application Ser. No. 15/212,416 filed on Jul. 18, 2016 which claims priority under 35 U.S.C. 119(a) to Application No. 10-2016-0023483, filed in the Republic of Korea on Feb. 26, 2016, all of which are hereby expressly incorporated by reference into the present invention.

BACKGROUND

1. Field

The present disclosure relates to a compressor, and more particularly, to a high pressure compressor in which an inner space of a casing forms a high pressure portion, and a refrigerating cycle device having the same.

2. Background

In general, a compressor is applicable to a vapor compression type refrigerating cycle (hereinafter, abbreviated as a "refrigerating cycle"), such as a refrigerator, air conditioner or the like.

Compressors may be divided into an indirect suction method and a direct suction method according to a method of sucking refrigerant into a compression chamber. The indirect suction method is a method in which refrigerant circulating a refrigerating cycle is introduced to an inner space of the compressor casing and then sucked into the compression chamber. The direct suction method is a method in which refrigerant is directly sucked into the compression chamber, contrary to the direct suction method. The indirect suction method and the direct suction method may be also classified as a low pressure compressor and a high pressure compressor, respectively.

For the low pressure compressor, as refrigerant is first introduced into an inner space of a compressor casing, liquid refrigerant or oil is filtered out at the inner space of the compressor casing, and accordingly an additional accumulator is not provided therein. On the contrary, for the high pressure compressor, an accumulator is typically provided at the side of suction rather than the compression chamber to prevent the liquid refrigerant or oil from introduced into the compression chamber.

The high pressure compressor forms a high pressure portion in which an inner space of the casing is a discharge space, and an inner space of the accumulator forms a low pressure portion. As a result, when the power of refrigerating cycle is off during the operation, the compressor is unable to perform instant restart due to a large difference between a suction pressure and a discharge pressure of the compressor. Accordingly, most of air conditioners using a high pressure compressor implement an additional operation, so-called "3-minute restart", in which the operation of the compressor is stopped (OFF) and then the stop (OFF) of the operation continues for a predetermined period of time to secure an equilibrium pressure time so as to adjust the suction pressure and discharge pressure within a predetermined range.

In particular, in the unitary air conditioner field in the North America region, a fan in the refrigerating cycle is operated while implementing an additional operation such as 3-minute restart when the compressor stops to use latent heat until a differential pressure generated during the operation of the refrigerating cycle device reaches an equilibrium pressure, thereby maximizing the efficiency of the refrigerating cycle device.

However, a period of time for allowing a differential pressure of the refrigerating cycle device to reach an equilibrium pressure (hereinafter, a differential pressure section or pressure equalization time) is long, oil within the compressor is leaked through a gap between members to reduce an oil level within the compressor as well as the compressor is not restarted, thereby causing difficulties in applying the high pressure compressor to a refrigerating device such as an air conditioner. In other words, oil in the inner space of the casing is leaked into an accumulator at a relatively low pressure compared to the inner space of the casing through a gap between members to reduce the level of the oil stored in the inner space of the compressor casing by a difference between the suction pressure and the discharge pressure. In particular, the rotary compressor is not restarted even when a differential pressure between a suction pressure and a discharge pressure is small such as 1 $kgf/cm^2$ due to characteristics thereof. Consequently, when the compressor is stopped once, the compressor is not easily restarted. However, when input power is continuously fed even in a state that the compressor is not restarted by the pressure difference, an overload is generated on the motor, and as a result, the stop state of the compressor may be prolonged while operating an over load protector (OLP). Accordingly, in consideration of the leakage of oil, a period of time for allowing the compressor to reach an equilibrium pressure should not be long, thereby causing difficulties in applying a rotary compressor in which a pressure equalization time is short to a refrigerating cycle device using latent heat during the pressure equalization time. Accordingly, in the region where the efficiency of the refrigerating cycle device is emphasized, there is a problem of causing difficulties in applying a rotary compressor which is a high pressure compressor to an air conditioner or the like.

Instead, in a unitary air conditioner to which the high pressure compressor is applied, a method of providing an orifice between the condenser and the evaporator to rapidly reach an equilibrium pressure may be applicable thereto. However, when a pressure equalization time is reduced using the orifice, the use of latent heat during the differential pressure section is also disabled, and thus it is also disadvantageous in the aspect of efficiency, thereby causing difficulties in applying the high pressure compressor to a refrigerating device such as an air conditioner.

Furthermore, when a rotary compressor in the related art is applied, during reoperation subsequent to the stop of the refrigerating cycle device, the restart of the compressor may not be efficiently carried out, and thus an over load protector for preventing an overload of a motor may be repetitively operated, and as a result the over load protector may be damaged or burned out due to an overheating of the motor, thereby reducing the reliability of the compressor.

BRIEF DESCRIPTION OF THE DRAWINGS

Embodiments will be described in detail with reference to the following drawings in which like reference numerals refer to like elements, and wherein:

FIGS. 5A through 6B are block diagrams illustrating the operations of a rotary compressor in the related art and a rotary compressor of the present disclosure and graphs illustrating pressure changes and current changes thereof, wherein FIGS. 5A and 5B are views illustrating a rotary compressor in the related art, and FIGS. 6A and 6B are views illustrating the present disclosure;

FIGS. 7A and 7B are graphs in which a refrigerating cycle device to which a rotary compressor of the present disclosure is applied is compared with a refrigerating cycle device to which a rotary compressor in the related art, wherein FIG. 7A is a graph in which latent heat sections thereof are relatively compared and shown when the rotary compressor in the related art and the rotary compressor of the present disclosure are stopped during the operation at the same load, and FIG. 7B is a graph in which restart time points and stabilization processes for the rotary compressor in the related art and the rotary compressor of the present disclosure are compared and shown;

DETAILED DESCRIPTION

Hereinafter, a compressor according to present disclosure, a refrigerating cycle device to which the compressor is applied, and an operation method of the refrigerating cycle device will be described in detail based on an embodiment illustrated in the accompanying drawings.

Figure 1:
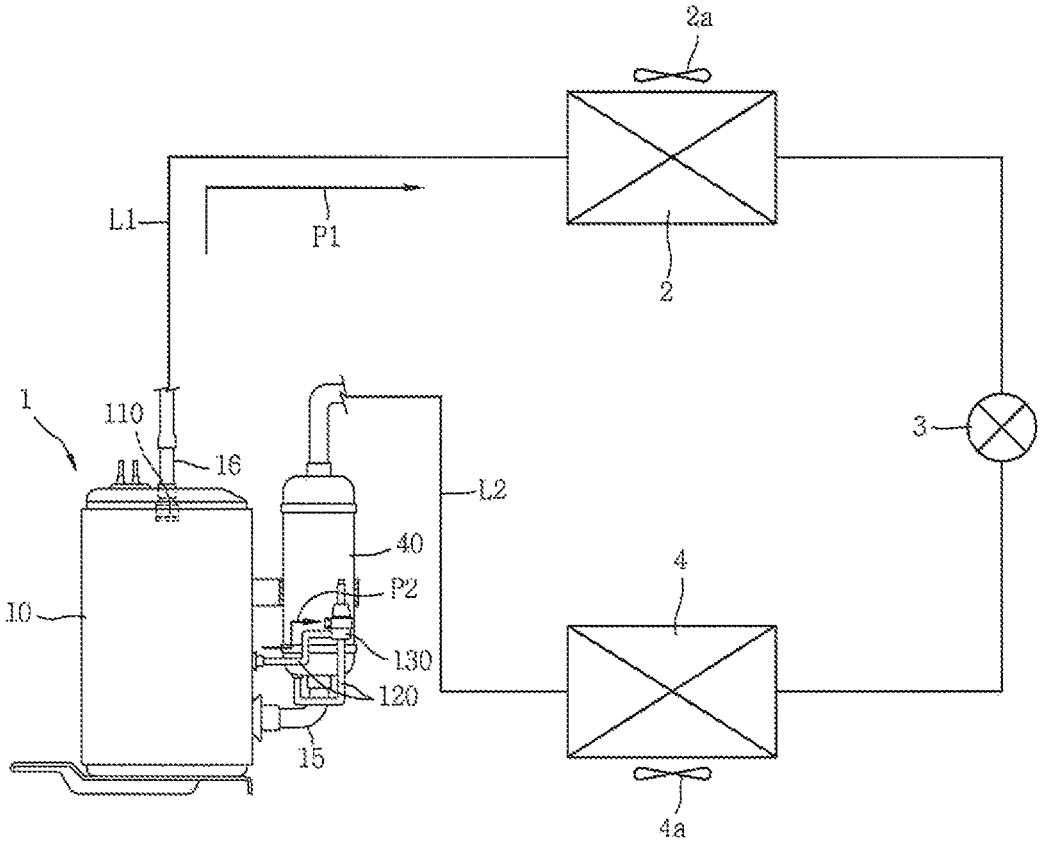
FIG. 1 is a schematic diagram illustrating a refrigerating cycle device according to the present disclosure.
Figure 2:
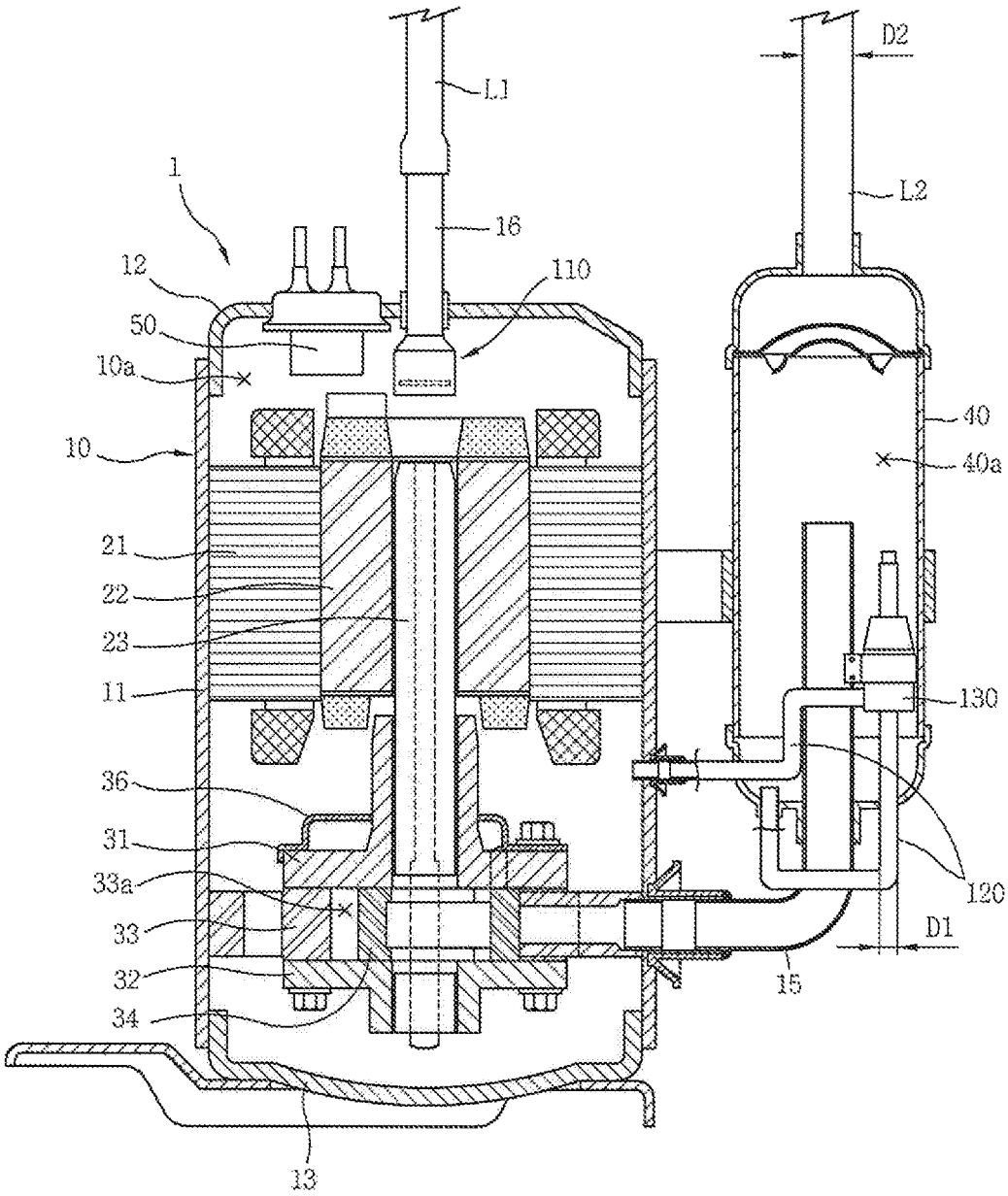
FIG. 2 is a longitudinal cross-sectional view illustrating a rotary compressor having an accumulator in a refrigerating cycle device according to FIG. 1.

FIG. 1 is a schematic diagram illustrating a refrigerating cycle device according to the present disclosure, and FIG. 2 is a longitudinal cross-sectional view illustrating a rotary compressor having an accumulator in a refrigerating cycle device according to FIG. 1.

Referring to FIG. 1, a refrigerating cycle device according to the present embodiment may include a compressor 1, a condenser 2, an expansion valve 3, and an evaporator 4. In case where the refrigerating cycle device is applied to a unitary air conditioner, a compressor, an outdoor heat exchanger (condenser or evaporator), and an outdoor fan (condenser fan or evaporator fan) are provided at an outdoor unit, and an indoor heat exchanger (evaporator or condenser) and an indoor fan (evaporator fan or condenser fan) are provided at an indoor unit.

Though not shown in the drawing, a refrigerant switching valve (not shown) may be provided between the discharge side and the suction side of the compressor 1 to switch the refrigerating cycle device to a heating device or cooling device while switching the circulation direction of refrigerant discharged from the compressor 1 to an outdoor unit or indoor unit. A cooling device is illustrated in FIG. 1 as a system diagram in which the refrigerant switching valve is not shown, for example.

Refrigerant at a high pressure discharged from the compressor 1 moves to the condenser 2 provided at an outdoor unit, and the refrigerant repeats a series of circulation processes in which the refrigerant is condensed in the condenser 2 and expanded while passing through the expansion valve 3, and the expanded refrigerant is sucked again into the compressor 1 in a state of being evaporated through the evaporator 4 provided at an indoor unit. Here, the compressor 1 may be consisted of a rotary compressor in which an inner space of the casing forms a discharge pressure state at a high pressure.

Referring to FIG. 2, in a rotary compressor 1 according to the present embodiment, a motor drive is provided in an inner space of a compressor casing 10, and a compression unit is provided at a lower side of the motor drive. The motor drive and compression unit are mechanically connected by a rotating shaft.

For the motor drive, a stator 21 is pressed and fixed to an inside of the compressor casing 10, and a rotor 22 is rotatably inserted into an inside of the stator 21. A rotating shaft 23 is pressed and coupled to the center of the rotor 22.

For the compression unit, a main bearing 31 supporting the rotating shaft 23 is fixed and coupled to an inner circumferential surface of the compressor casing 10, and a sub-bearing 32 supporting the rotating shaft 23 along with the main bearing 31 is fixed to the main bearing 31 by a predetermined distance at a lower side of the main bearing 31, and a cylinder 33 forming a compression space 33*a* is provided between the main bearing 31 and the sub-bearing 32. A rolling piston 34 compressing refrigerant while performing an orbiting movement along with the rotating shaft 23 in the compression space 33*a* is provided in the compression space 33*a* of the cylinder 33, and a vane 35 partitioning the compression space 33*a* into a suction chamber and a compression chamber along with the rolling piston 34 is slidably inserted into an inner wall of the cylinder 33.

A discharge port 31*a* for discharging refrigerant compressed in the compression space 33*a* may be formed on the main bearing 31, and a discharge valve 36 for opening or closing the discharge port 31*a* is formed at an end portion of the discharge port 31*a*. A discharge muffler 37 having a predetermined noise space is provided on an upper surface of the main bearing 31.

As a result, the discharge valve 36 may be opened or closed according to a difference between an internal pressure (hereinafter, suction pressure, Ps) of the compression space and an internal pressure (hereinafter, discharge pressure, Pd) of the inner space of the casing 10 (particularly, a noise space of the discharge muffler. Accordingly, when the suction pressure (Ps) is too low, a pressure difference between the suction pressure (Ps) and the discharge pressure (Pd) becomes too large, and consequently, the suction pressure (Ps) is unable to discharge refrigerant in the compression space 33*a* due to being unable to reach a discharge allowable pressure (a pressure capable of opening the discharge valve). Then, the over load protector 50 provided in the drive motor (hereinafter, used interchangeably with a motor) is operated while an overload is applied to the drive motor to stop the motor, thus removing a compression load from the compression unit.

On the other hand, the compressor casing 10 may include a circular cylinder body 11, both the top and bottom ends of which are open, and an upper cap 12 and a lower cap 13 covering both the top and bottom ends of the circular cylinder body 11 to seal the inner space 10*a*. A suction pipe 15 connected to an outlet side of an accumulator 40 which will be described later may be coupled to a lower half portion of the circular cylinder body 11, and a discharge pipe 16 connected to a discharge side refrigerant pipe (L1) may be coupled to an inlet side of the condenser 2 which will be described later on the upper cap 12. The suction pipe 15 may be directly connected to a suction port 33*b* of the cylinder 33 through the circular cylinder body 11, and the discharge pipe 16 may be communicated with the inner space 10*a* of the compressor casing 10 through the upper cap 12.

The accumulator 40 may be disposed at one side of the compressor casing 10, and an inner space 40*a* separated from the inner space 10*a* of the compressor casing 10 may be formed to have a predetermined volume within the accumulator 40. The evaporator 4 may be connected to an upper portion of the accumulator 40 with a suction side refrigerant pipe (L2), and the suction pipe 15 connected to the cylinder 33 of the compressor casing 10 may be connected to a lower portion of the accumulator 40.

The suction side refrigerant pipe (L2) may be connected to an upper surface of the accumulator 40, and the suction pipe 15 may be formed in an L-shape and deeply inserted and connected to an inside of the scent strength display means 40*a* of the accumulator 40 by a predetermined height through a lower surface of the accumulator 40.

In a rotary compressor according to the foregoing present embodiment, when power is applied to the stator 21, the rolling piston 34 performs an orbiting movement while the rotor 22 and rotating shaft 23 rotate within the stator 21, a volume of the suction chamber varies according to the orbiting movement of the rolling piston 34 to suck refrigerant into the cylinder 33.

The refrigerant is discharged to the inner space 10*a* of the casing 10 through the discharge port 31*a* provided in the main bearing 31 while being compressed through generating a compression load in the compression space 33*a* by the rolling piston 34 and vane 35, and refrigerant discharged to the inner space 10*a* of the casing 10 is exhausted to the refrigerating cycle device through the discharge pipe 16, and refrigerant exhausted to the refrigerating cycle device is introduced into the accumulator 40 through the condenser 2, expansion valve 3 and evaporator 4, and liquid refrigerant and oil are separated from gas refrigerant while the refrigerant passes through the accumulator 40 prior to being sucked into the cylinder 33, and a series of processes of sucking gas refrigerant into the cylinder 33 while evaporating liquid refrigerant from the accumulator 40 and then sucking it into the cylinder 33 are repeated.

At this time, even when the operation of the refrigerating cycle device is stopped and the compressor 1 is temporarily off to remove a compression load in the compression space 33*a*, refrigerant that has been exhausted from the compressor 1 to the refrigerating cycle moves in a direction from the condenser 2 forming a relatively high pressure to the evaporator 4 forming a relatively low pressure by a pressure difference between the suction side and the discharge side based on the compression unit. Accordingly, when the outdoor fan 2*a* and indoor fan 4*a* of the refrigerating cycle device is operated in a state that the compressor 1 is stopped, namely, in a state that the compression load of the compression unit is removed, refrigerant may continue to exchange heat using latent heat while moving according to a pressure difference, thereby enhancing the efficiency of the refrigerating cycle device.

However, the foregoing rotary compressor is unable to restart even when a pressure difference between a suction pressure (a pressure (Ps) of the compression space) and a discharge pressure (a pressure (Pd) of the inner space of the casing) is small such as 1 kgf/cm$^2$ due to characteristics thereof and thus a pressure equalization time should be carried out for a long period of time. However, when the pressure equalization time is carried out for a long period of time, oil leakage increases and thus in reality, the pressure equalization time cannot be carried out for a long period of time. Accordingly, the pressure equalization time should be carried out for a short period of time as far as possible, but in that case, the compressor may be in a state of not being reached an equilibrium pressure yet, and thus the compressor is unable to restart since the compressor does not reach an equilibrium pressure required for restart even though the reoperation of the refrigerating cycle device is attempted again. Moreover, when the pressure equalization time is set to short, latent heat may not be used during a differential pressure section, thereby reducing energy efficiency in that amount.

In consideration of this, according to the present embodiment, a check valve (hereinafter, first valve) is provided at en inlet end or inlet side of the discharge pipe in the inner space of the compressor casing to prevent the discharged refrigerant from flowing back from the outside to the inside so as to allow a differential pressure operation to be long during a differential pressure section corresponding to the pressure equalization time as well as a bypass pipe and a solenoid valve (hereinafter, second valve) for selectively opening and closing the bypass pipe are provided between the middle of the discharge pipe and a suction side of the accumulator to allow the suction side and the discharge side of the compression unit to quickly reach an equilibrium pressure that rapidly reaches an equilibrium pressure during the stop of the compressor, thereby efficiently implementing restart in a high pressure compressor such as a rotary compressor.

For the purpose of this, a refrigerant passage may include a first refrigerant passage (P1) connected between the discharge side and the suction side based on the compression unit and a second refrigerant passage (P2) connecting both end portions of the first refrigerant passage (P1) to each other. One end of the second refrigerant passage (P2) may be connected to the discharge side based on the compression unit (particularly, discharge valve), and the other end of the second refrigerant passage (P2) may be connected to the suction side based on the compression unit.

For example, if one end of the first refrigerant passage (P1) is from the inner space 10*a* of the compressor casing 10 at the discharge side to the compression space 33*a* of the cylinder at the suction side based on the discharge valve 36 of the compression unit, then the first refrigerant passage (P1) may be a passage in which refrigerant discharged to the inner space 10*a* of the compressor casing 10 is connected to the compression space 33*a* including the refrigerating cycle consisting of the condenser 2, the expansion valve 3 and the evaporator 4.

Furthermore, the second refrigerant passage (P2) may be a passage in which refrigerant is directly connected thereto without passing through the condenser 2, the expansion valve 3 and the evaporator 4 between the inner space 10*a* of the compressor casing 10 and the compression space 33*a* of the compression unit based on the discharge valve 36 of the compression unit.

Here, the second refrigerant passage (P2) may be formed with the bypass pipe 120, both ends of which are connected to the inner space 10*a* of the compressor casing 10 and the inner space 40*a* of the accumulator 40, respectively, as illustrated in FIGS. 1 and 2.

Furthermore, a check valve 110 which will be described later, and a solenoid valve 130 which will be described later may be provided at the first refrigerant passage (P1) and the second refrigerant passage (P2), respectively.

Figure 3A:
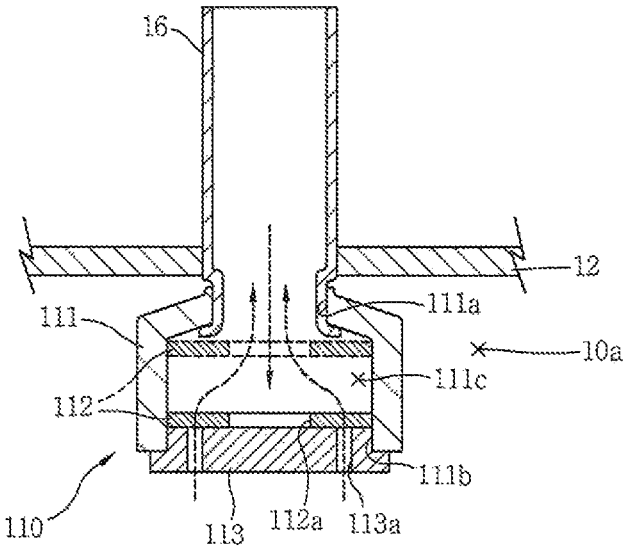
FIGS. 3A and 3B are longitudinal cross-sectional views illustrating a first valve and a second valve, respectively, in a compressor according to FIG. 2.
Figure 3B:
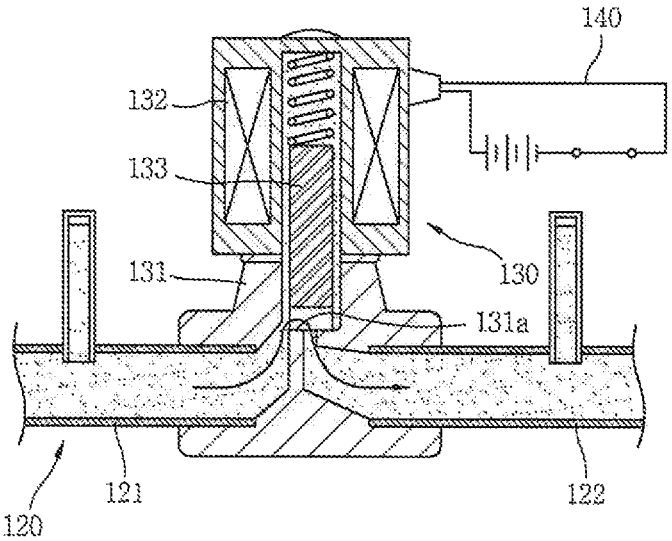

FIGS. 3A and 3B are longitudinal cross-sectional views illustrating a first valve and a second valve, respectively, in a compressor according to FIG. 2.

Referring to FIGS. 1 and 2, the first valve 110 may be provided at an inlet end of the discharge pipe 16 in the inner space 10*a* of the compressor casing 10. As a result, a substantial internal volume of the compressor 1 may be reduced compared to the first valve 110 being provided at the discharge pipe 16 at an outside of the casing 10, thereby further shortening the pressure equalization time.

Here, the first valve 110 may be consisted of a uni-directional valve capable of blocking refrigerant discharged from the compressor casing 10 toward the condenser 2 from flowing backward into the inner space 10*a* of the compressor casing 10 during the stop of the compressor 10, namely, during the removal of a compression load in the compression space 33*a*. Of course, the check valve 110 may include an electronic valve, but a mechanical valve may be appropriate in consideration of the cost, reliability and the like.

Referring to FIG. 3A, the first valve 110 may include a housing 111 provided to communicate with an inlet end or inlet side of the discharge pipe 16 in the inner space 10*a* of the compressor casing 10, and a valve body 112 accommodated into the housing 111 to open or close the housing 111 while moving according to pressure difference therebetween.

Both ends of the housing 111 are open to form a condenser side opening end (first opening end) 111*a* and a compressor side opening end (second opening end) 111*b*, and a valve space 111*i* for allowing the valve body 112 to move may be formed in an extended manner between the first opening end 111*a* and the second opening end 111*b*.

The first opening end 111*a* may be open and connected to the discharge pipe 16, and a valve cover 113 having a penetration hole 113*a* to be opened or closed by the valve body 112 may be coupled to the second opening end 111*b*.

The valve body 112 may be formed in a piston shape, but preferably formed with a thin plate body in consideration of the valve responsiveness or the like.

Furthermore, the valve body 112 may be formed with a gas communication groove 112*a* at a central portion thereof. As a result, when the valve body 112 is brought into contact with the first opening end 111*a*, the first opening end 111*a* is open, but when the valve body 112 is brought into contact with the second opening end 111*b*, it may be possible to completely block the penetration hole 113*a* of the valve cover 113 provided in the second opening end 111*b*.

On the other hand, as described above, a bypass pipe 120 is provided between the compressor casing 10 and the accumulator 40, and a second valve 130 formed with a solenoid valve may be provided at the bypass pipe 120.

Furthermore, the second valve 130 may be electrically connected to a controller 140 for controlling the entire refrigerating cycle device including the second valve 130, namely, the controller 140 for controlling the compressor 1 in linkage with the compressor 1.

Accordingly, the second valve 130 may be controlled in linkage with the compressor 1 by the controller 140. For example, when the compressor 1 is stopped to remove a compression load of the compression space 33*a*, the second valve 130 may be controlled to be opened while at the same time stopping the compressor, and when the compressor 1 is restarted to generate a compression load in the compression space 33*a*, the second valve 130 may be controlled to be closed while at the same time restarting the compressor 1.

Here, one end of the bypass pipe 120 may be connected to communicate with the inner space 10*a* of the compressor casing 10 corresponding to a current side than the first valve 110 based on the discharge direction of refrigerant, and the other end of the bypass pipe 120 may be connected to the inner space 10*a* of the accumulator 40. Of course, one end of the bypass pipe 120 may be connected to a side of the condenser 2 at a downstream side than the first valve 110 based on the first valve 110, but in this case, an equilibrium pressure operation should be carried out for a discharge side refrigerant pipe (L1) between the first valve 110 and the condenser 2, and thus a pressure equalization time may be delayed by that amount of time.

Furthermore, an inner diameter (D1) of the bypass pipe 120 may be formed to be the same or less than an inner diameter of the discharge pipe 16 or discharge side refrigerant pipe (L1) or an inner diameter (D2) of the suction side refrigerant pipe (L2). When the inner diameter (D1) of the bypass pipe 120 is larger than the inner diameter of the discharge pipe 16 or discharge side refrigerant pipe or the inner diameter (D2) of the suction side refrigerant pipe (L2), a flow rate of refrigerant may be reduced to delay a pressure equalization time as well as a size of the second valve 130 should be increased by that size to increase the cost.

Referring to FIG. 3B, the second valve 130 according to the present embodiment may include a housing 131 provided at the bypass pipe 120 and formed with a communication path 131*a* to communicate between a high pressure side (first end portion) 121 connected to the inner space 10*a* of the compressor casing 10 and a low pressure side (second end portion) 122 connected to the inner space of the accumulator, a drive unit 132 formed within the housing 131 and electrically connected to the controller 140, and a valve body 133 coupled to a mover (not shown) of the drive unit 132 to open or close the communication path 131*a* according to whether or not power is applied to the drive unit 132.

On the other hand, the second valve 130 may be consisted of a bi-directional valve in which an amount of opening is electrically controlled by an additional controller (not shown) for independently controlling the second valve 130 or the controller 140 for controlling the foregoing compressor (or refrigerating cycle). In this case, the second valve 130 may control an amount of opening to adjust a pressure equalization time.

Figure 4A:
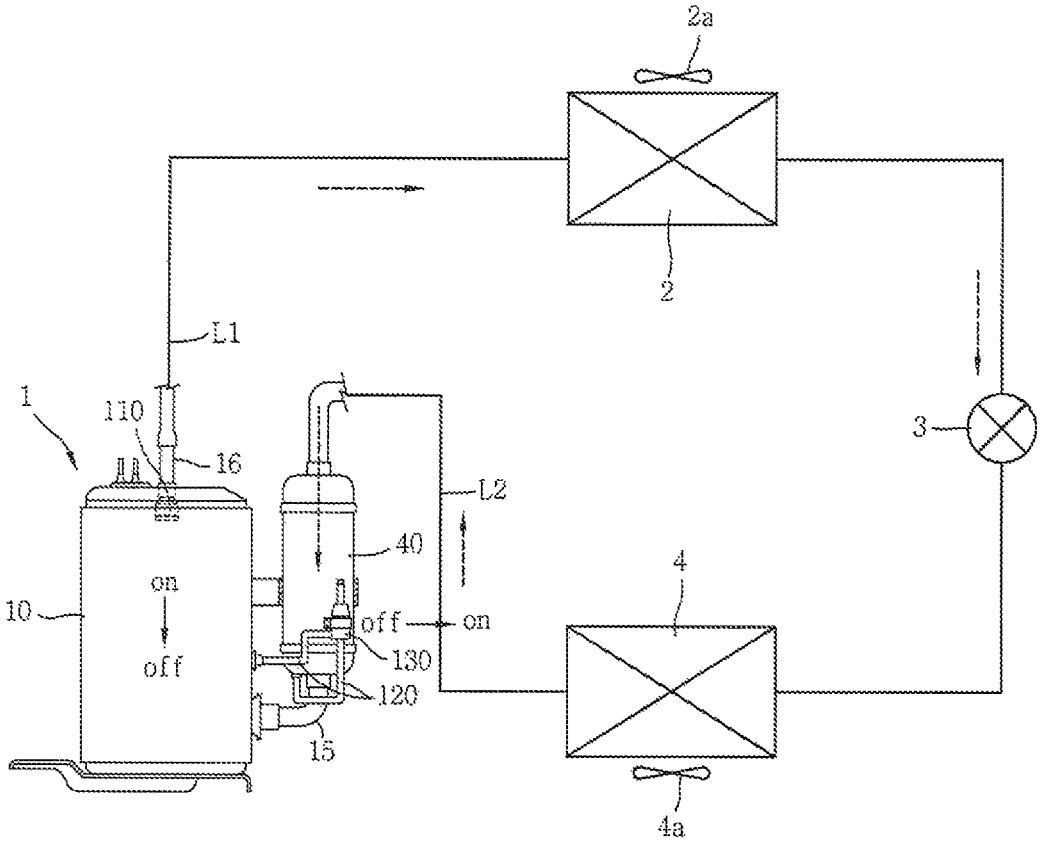
FIGS. 4A, 4B and 4C are schematic views for explaining a differential pressure operation, an equilibrium pressure, and a restart operation in a refrigerating cycle device according to FIG. 2.
Figure 4B:
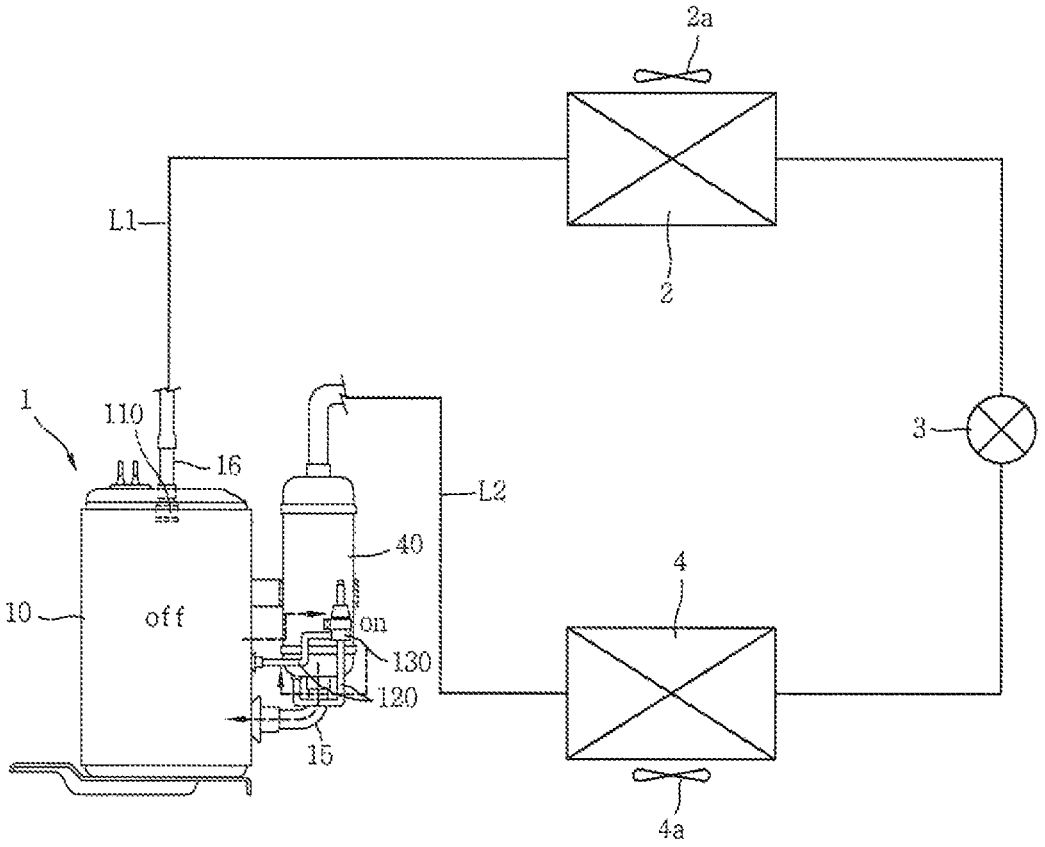
Figure 4C:
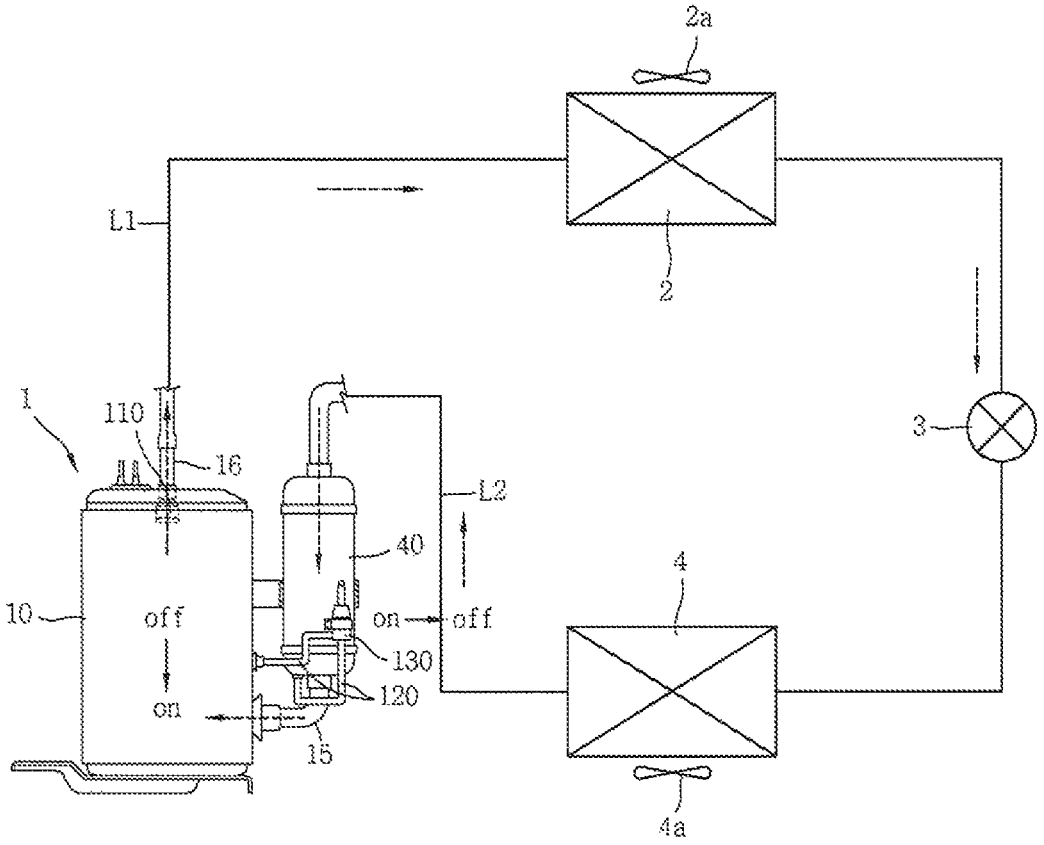

A refrigerating cycle device including the foregoing rotary compressor according to the present embodiment may be operated as follows. FIGS. 4A, 4B and 4C are schematic views for explaining a differential pressure operation, an equilibrium pressure, and a restart operation in a refrigerating cycle device according to FIG. 2.

Referring to FIG. 4A, when the compressor is stopped, then refrigerant discharged in the condenser direction through the discharge pipe 16 from the inner space 10*a* of the compressor casing 10 may flow backward into the inner space 10*a* of the compressor casing 10, but it may be suppressed by the first valve 110. Through this, the refrigerant may move only in the direction of the accumulator 40 through the expansion valve 3 and evaporator 4 from the condenser 2 according to a pressure difference. At this time, when the condenser fan 2*a* or evaporator fan 4*a* is operated, refrigerant passing through the condenser 2 and evaporator 4 may exchange heat with air even in a state that the compressor 1 is stopped, thereby enhancing the energy efficiency of the refrigerating cycle device by that amount.

Next, referring to FIG. 4B, the second valve 130 is on as illustrated in FIG. 4A while at the same time the compressor 1 is stopped to open the bypass pipe 120. Then, part of the refrigerant discharged to the compressor casing 10 moves to a side of the bypass pipe 120 by a difference between the inner space 10*a* of the compressor casing 10 and the inner space 40*a* of the accumulator 40 without moving in the direction of the condenser and moves to the inner space 40*a* of the accumulator 40. Then, a pressure of the inner space 40*a* of the accumulator 40 and a pressure of the inner space 10*a* of the compressor casing 10 form an equilibrium pressure within a predetermined range (typically, 1 kgf/$cm^2$). Then, the compressor 1 may maintain an equilibrium pressure state capable of allowing the suction pressure (Ps) and discharge pressure (Pd) to start the compressor, and the compressor 1 may be in a state of waiting for restart.

Next, referring to FIG. 4C, when a user selects restart for the refrigerating cycle device that has been instantly stopped, the compressor may be quickly restarted to discharge refrigerant compressed in the compression space 33*a* into the inner space 10*a* of the compressor casing 10 while pressing the discharge valve 36 as the suction pressure (Ps) and the discharge pressure (Pd) become an equilibrium pressure state as illustrated in FIG. 4B in the above. As a result, the refrigerating cycle device may be efficiently restarted. At this time, the second valve 130 is switched from an open state to a closed state to block refrigerant discharged to the inner space 10*a* of the compressor casing 10 from moving to the inner space 40*a* of the accumulator 40 through the bypass pipe 120.

Figure 5A:
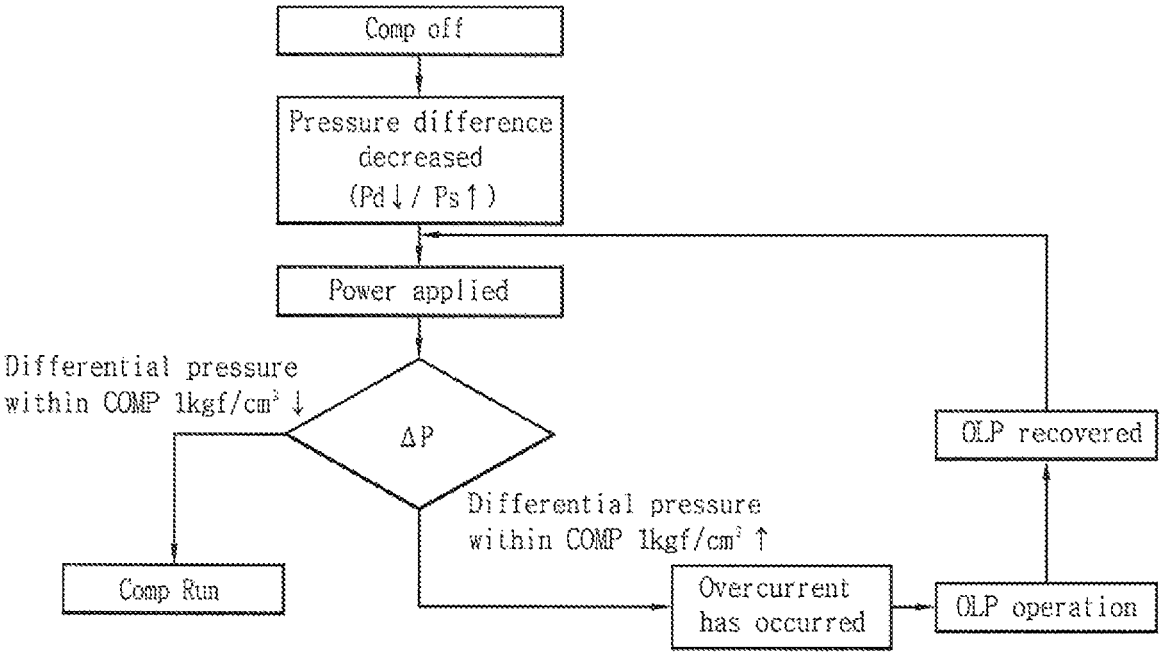
Figure 5B:
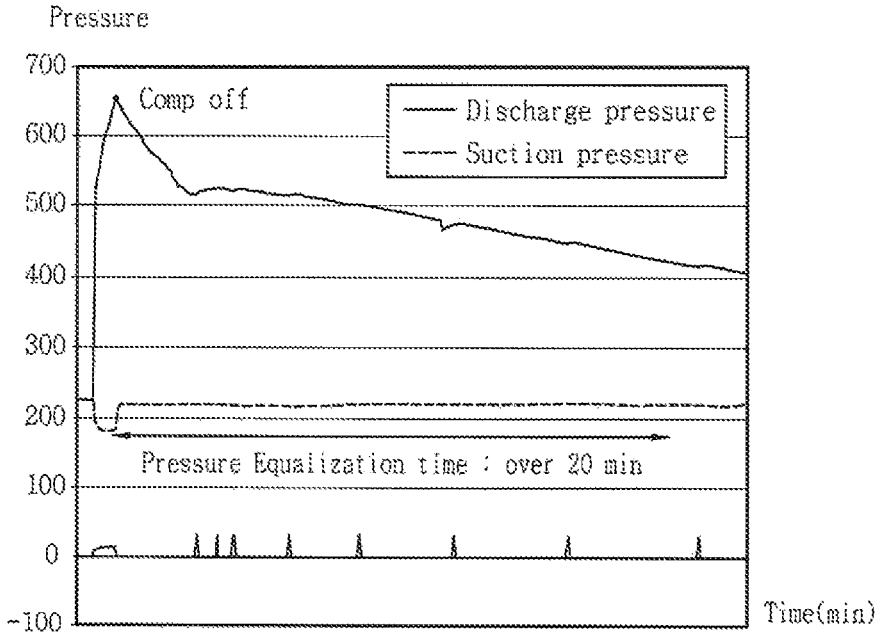
Figure 6A:
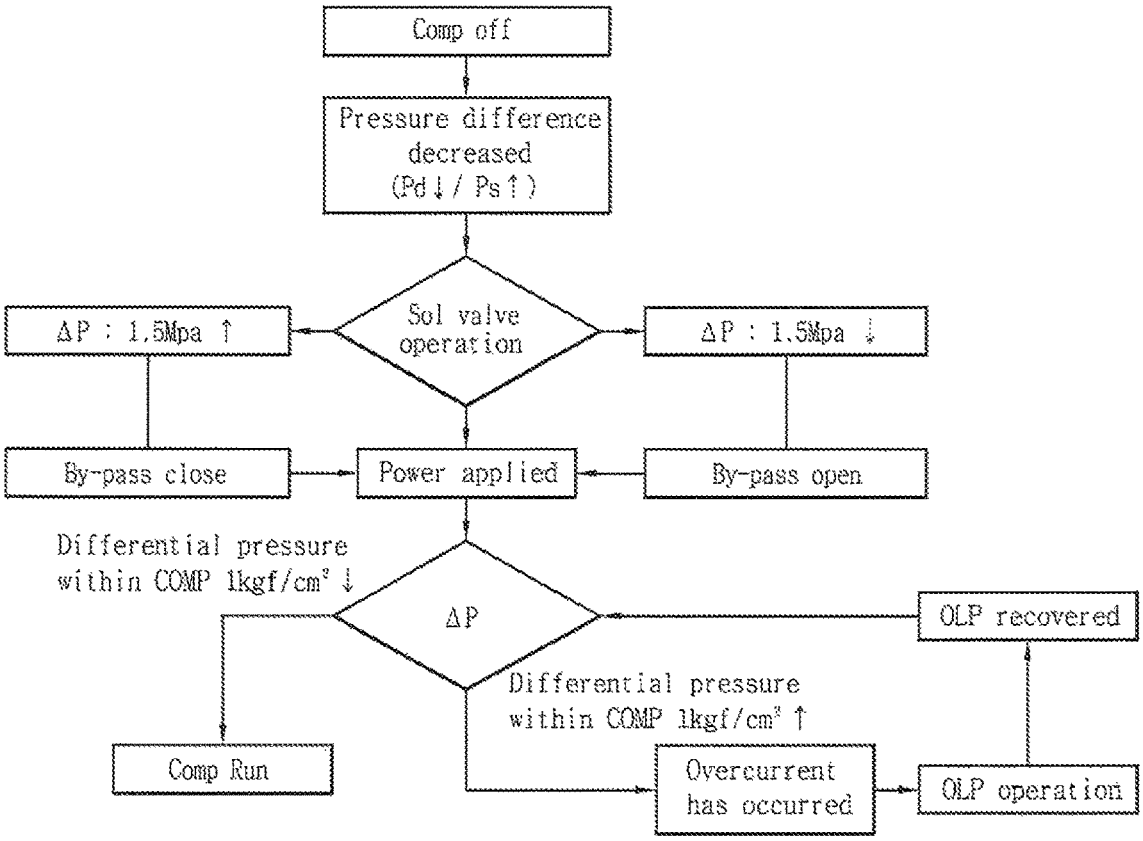
Figure 6B:
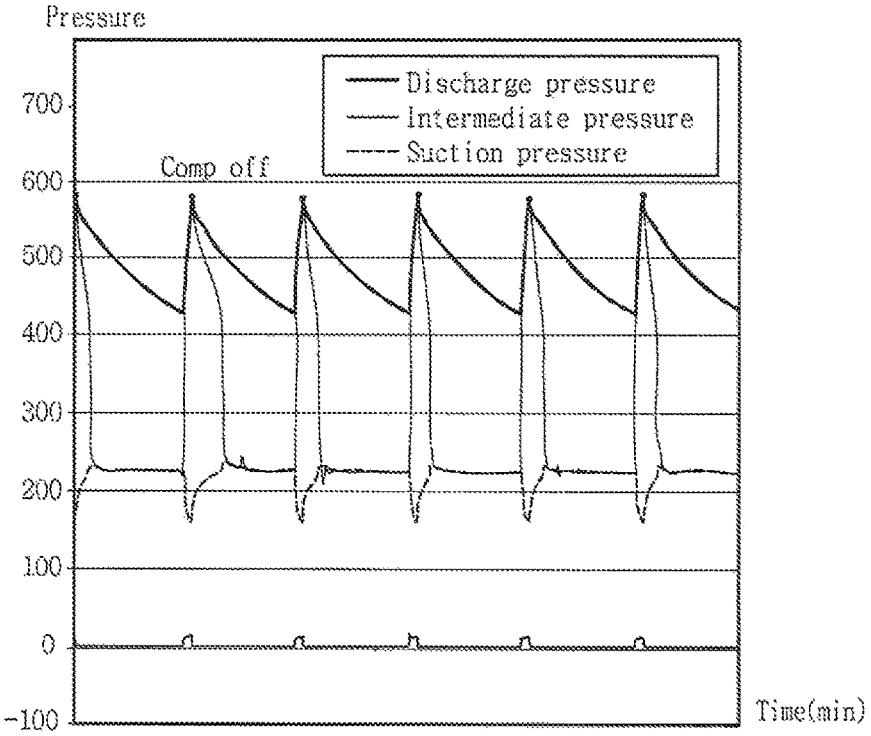

FIGS. 5A through 6B are block diagrams illustrating the operations of a rotary compressor in the related art and a rotary compressor of the present disclosure and graphs illustrating pressure changes and current changes thereof, wherein FIGS. 5A and 5B are views illustrating a rotary compressor in the related art, and FIGS. 6A and 6B are views illustrating the present disclosure.

Referring to FIG. 5A, in case where a rotary compressor in the related art is applied to the refrigerating cycle device, the discharge pressure (Pd) is continuously reduced and the suction pressure (Ps) is instantly increased and then maintained when the compressor is stopped.

Here, when a user operates the refrigerating cycle device to apply power to the compressor, the compressor immediately restart the operation when a pressure difference within the compressor, namely, a differential pressure (ΔP) between the suction pressure (Ps) and the discharge pressure (Pd) corresponds to an equilibrium pressure condition (typically, within 1 kgf/$cm^2$).

However, when a pressure difference within the compressor is larger than an equilibrium pressure condition, the compressor is unable to restart and discharge refrigerant. Then, the over load protector 50 is operated while an overcurrent is generated on the drive motor which is a motor drive to block power supplied to the drive motor. Then, after a recovery time of the over load protector 50 has passed, the over load protector 50 is recovered and power is applied again to the drive motor. However, when a pressure within the compressor does not satisfy an equilibrium pressure condition yet, the compressor repeats the foregoing operation. As described above, according to a rotary compressor in the related art, a time for reaching an equilibrium pressure condition takes long, and thus the foregoing process is repeated several times.

It is shown in a graph as illustrated in FIG. 5B. In other words, since refrigerant discharged from the compressor 1 has passed through the entire refrigerating cycle followed by the condenser 2, expansion valve 3 and evaporator 4 and introduced into the compressor during the stop of the compressor, a discharge pressure (solid line) is gradually decreased. As a result of the experiment, it is seen that approximately 20 minutes is required to reach a pressure condition (equilibrium pressure condition) capable of restarting the compressor.

Furthermore, though a restart current is applied to the drive motor until the equilibrium pressure condition is reached as illustrated in the lower graph of FIG. 5B, the compressor fails to restart several times, and currents with a high peak point periodically appear. A point at which the peak point appears is a point at which the over load protector 50 is operated, and an interval between the peak points is an interval during which the over load protector 50 is recovered again. As illustrated in the drawing, intervals between peak points gradually increase because the over load protector 50 is overheated as the compressor repeatedly undergoes restart failures, thereby delaying a recovery time to that extent. Accordingly, a current is continuously applied to the drive motor even in a state that an equilibrium pressure condition capable of restarting the compressor has not been reached yet, and thus it is seen that the over load protector 50 for preventing an overload of the motor is repeatedly operated several times.

On the other hand, referring to FIG. 6A, when the compressor is stopped even in case that a rotary compressor according to the present embodiment is applied to a refrigerating cycle device, the discharge pressure is temporarily decreased and the suction pressure is temporarily increased.

Then, the operation of the second valve 130 which is a solenoid valve, and the second valve 130 maintains a closed state when a pressure difference between a high pressure side and a low pressure side exceeds a predetermined range (approximately, 1.5 MPa) based on the second valve 130, but the second valve 130 is opened when it is less than the predetermined range.

Here, the solenoid valve may not be opened according to the type thereof when a pressure difference between a high pressure side and a low pressure side is very large (approximately, above 1.5 MPa) based on the solenoid valve. However, in a common condition other than a very severe condition, a pressure difference between both sides may be within 1.5 MPa, and the second valve may be opened while at the same time stopping the compressor.

Then, part of refrigerant discharged to the inner space 10*a* of the compressor casing 10 moves to a suction side which is a low pressure portion through the bypass pipe 120 while opening the second valve 130, and thus the suction pressure (Ps) and the discharge pressure (Pd) within the compressor satisfies an equilibrium pressure condition.

At this time, when the user operates the refrigerating cycle device to apply power to the drive motor, a pressure difference within the compressor is already in a state that an equilibrium pressure condition (typically, 1 kgf/$cm^2$) has been satisfied, and thus the compressor immediately resumes the operation. Of course, the compressor may not be restarted at once due to various reasons, but restart failures appear much less compared to a rotary compressor in the related art. It can be seen through FIG. 6B. For reference, FIG. 6B is a graph in which the on/off of the refrigerating cycle device is repeated several times during the same period of time as that of FIG. 5B to experiment whether or not the compressor is restarted.

As illustrated in the drawing, when the compressor is stopped, the discharge pressure (bold solid line) is temporarily reduced and the suction pressure is temporarily increased and then constantly maintained.

At this time, it is seen that the second valve 130 is operated to open the bypass pipe 120, and part of refrigerant discharged to the inner space 10*a* of the compressor casing 10 based on the compression unit moves to the inner space 40*a* of the accumulator 40 through the bypass pipe 120, and the discharge pressure (Pd) and the suction pressure (Ps) within the compressor quickly reach an equilibrium pressure condition, and as a result, the inner space 10*a* of the compressor forms an intermediate pressure (thin solid line).

Accordingly, as illustrated with a bold solid line in FIG. 6B, it is seen that the compressor of the present disclosure carries out restart several times during the same period of time compared to that of FIG. 5B while the fluctuation of the discharge pressure (Pd) is repeated several times.

As illustrated at the lower side of FIG. 6B, it is seen that a normal current is supplied for the most section to stably resume the operation when a restart current is supplied to the motor.

During the stop of the refrigerating cycle device, the suction pressure and discharge pressure may quickly form an equilibrium pressure while at the same time stopping the compressor to efficiently carry out the restart of the compressor, and through this, the on/off of the over load protector may not be frequently repeated, thereby preventing the failure of the over load protector in advance. In addition, the drive motor may be prevented from being overheated due to overpressure and from being burned out due to overheat, thereby enhancing the reliability of the compressor.

Figure 7A:
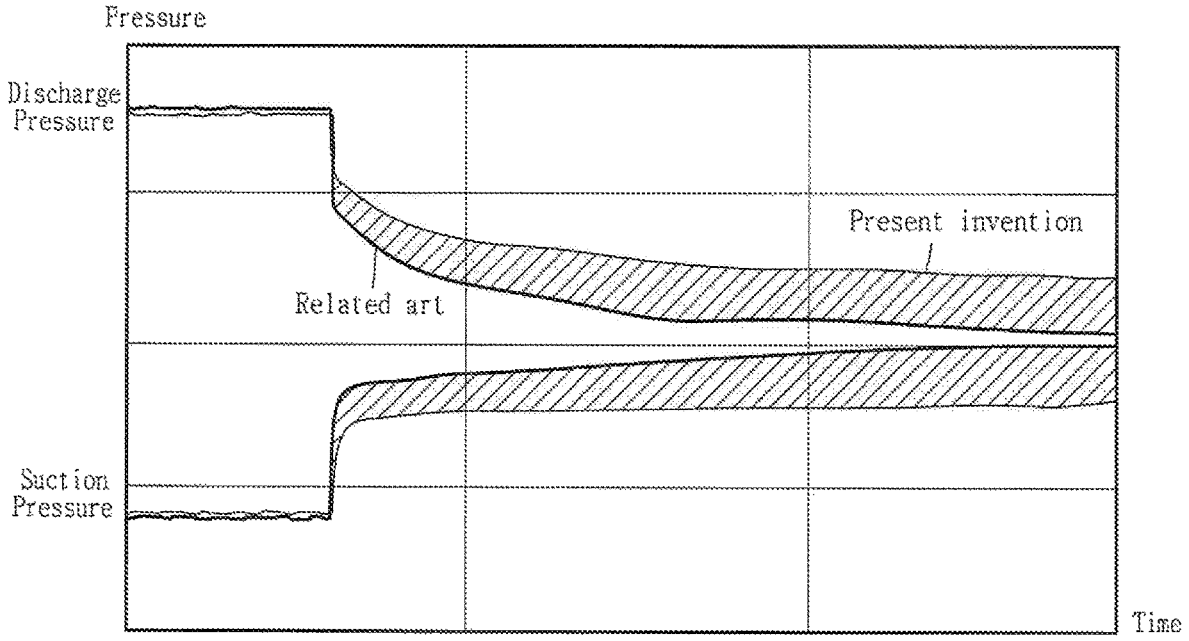
Figure 7B:
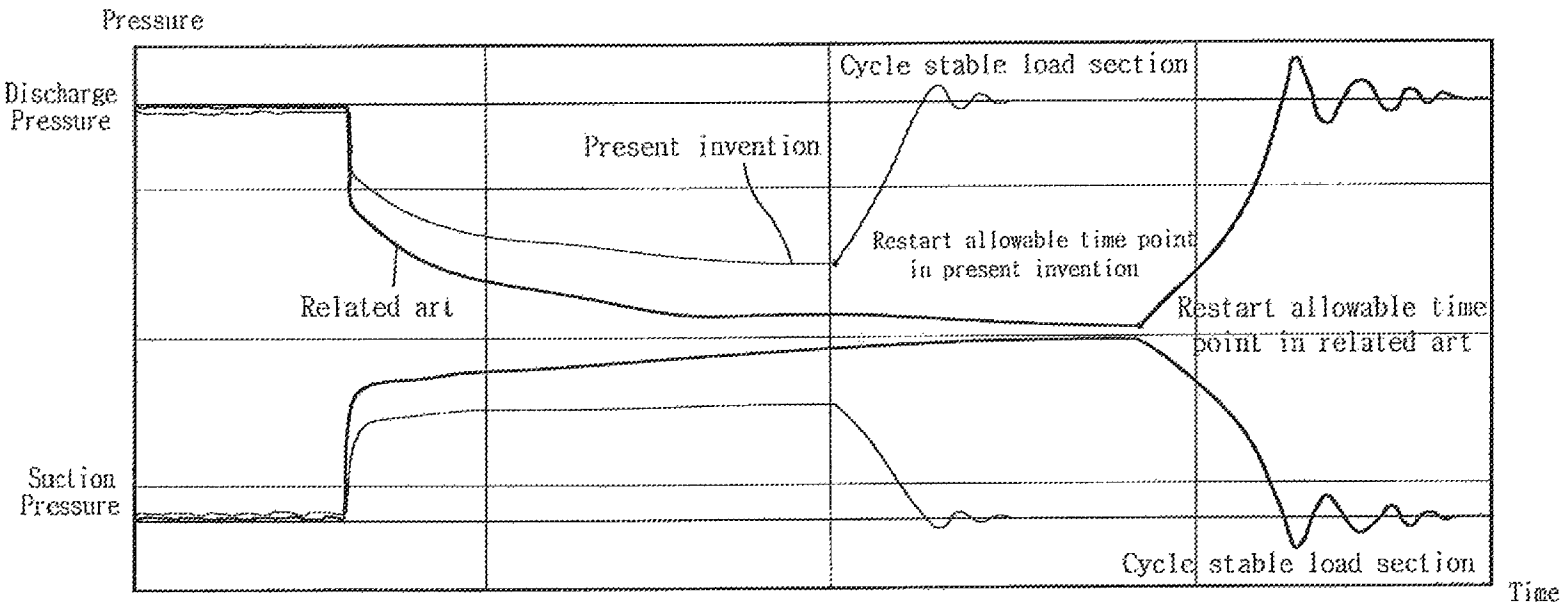

Furthermore, even when the refrigerating cycle device to which a high pressure compressor such as a rotary compressor is applied is temporarily stopped, a so-called differential pressure operation for operating a fan in the refrigerating cycle device may continue for the stopped time period, thereby enhancing the energy efficiency of the refrigerating cycle device. It will be seen through FIGS. 7A and 7B. FIG. 7A is a graph in which latent heat sections thereof are relatively compared and shown when the rotary compressor in the related art and the rotary compressor of the present disclosure are stopped during the operation at the same load, and FIG. 7B is a graph in which restart time points and stabilization processes for the rotary compressor in the related art and the rotary compressor of the present disclosure are compared and shown.

Referring to FIG. 7A, it is seen that the suction pressure abruptly increases at a time point at which the compressor is stopped and then gradually increases, but in particular, a case of the related art increases faster from a higher pressure compared to a case of the present disclosure. On the contrary, it is seen that the discharge pressure abruptly decreases at a time point at which the compressor is stopped and then gradually decreases, but in particular, a case of the related art decreases faster from a lower pressure compared to a case of the present disclosure.

In case of the related art, part of refrigerant discharged from the compressor flows backward from a side of the condenser to a side of the compressor at a relatively low pressure by a pressure difference during the stop of the compressor, and the backward flowing refrigerant forms a relatively high pressure than that of refrigerant remaining in the inner space of the compressor casing. Then, the refrigerant remaining in the inner space of the compressor casing is pushed out, and the pushed-out refrigerant is leaked in the direction of the accumulator through a gap between members constituting the compression unit.

On the contrary, in case of the present disclosure, the first valve 110 which is a check valve may be provided at the discharge pipe to block refrigerant from flowing backward from a side of the condenser to a side of the compressor, and thus it may be possible to maintain a low suction pressure and a high discharge pressure compared to the foregoing compressor in the related art. Moreover, a change width between the suction pressure and the discharge pressure is relatively low, and as a result, a latent heat usage rate during the same section increases by approximately 35%. It is a shaded area in FIG. 7A.

Accordingly, a size of pressure difference from a heat exchange allowable section in a state that the compressor is stopped may be large, and in the heat exchange efficiency aspect of a unitary type refrigerating cycle device, it may be enhanced compared to the related art, thereby decreasing power consumption as well as increasing energy efficiency.

Moreover, in case of the related art, as oil remaining in the compressor casing is pushed out while refrigerant is leaked in the direction of the accumulator from the compressor casing, it may cause oil shortage in the inner space of the compressor casing, and as a result, in case of the related art, a friction loss during the operation of the compressor may increase, but the present disclosure may also reduce a friction loss due to such a reason, thereby further increasing energy efficiency.

On the other hand, referring to FIG. 7B, in case where a rotary compressor in the related art is applied, as described above, refrigerant discharged from the compressor may be circulated through the evaporator, the expansion valve and the evaporator, and thus a time required to satisfy a state capable of restarting the compressor, namely, an equilibrium pressure condition (differential pressure: 1 $kgf/cm^2$) between the suction pressure and the discharge pressure (pressure equalization time) may be quite large compared to the present disclosure. Accordingly, a restart allowable time point for a rotary compressor in the related art may be significantly delayed compared to that for the rotary compressor of the present disclosure. As a result, when a rotary compressor in the related art is applied, the compressor may not be quickly restarted even when a user attempts to operate the refrigerating cycle device again, and thus the refrigerating cycle device may be also unable to quickly resume the operation, thereby causing the foregoing problem illustrated in the description of FIG. 5B.

On the contrary, according to the present disclosure, as an equilibrium pressure may be carried out using the bypass pipe 120 and second valve 130 while at the same stopping the compressor as described above, and thus an additional pressure equalization time may not be needed or significantly shortened compared to that of the related art even if it is needed. Accordingly, when a user attempts to restart the refrigerating cycle device, the compressor may be quickly restarted, thereby allowing the refrigerating cycle device to enter a normal operation significantly faster compared to the related art. Therefore, the present disclosure may significantly enhance energy efficiency compared to the related art.

Moreover, even when a stable load section of the refrigerating cycle device is taken into consideration, it is seen that the present disclosure enters a stabilization process significantly faster compared to the related art. Through this, it is seen that the energy efficiency of the refrigerating cycle device to which a rotary compressor of the present disclosure is applied can be enhanced compared to that of the refrigerating cycle device to which a rotary compressor in the related art is applied.

On the other hand, another embodiment for a second valve in a rotary compressor according to the present disclosure will be described as follows.

In other words, the second valve is automatically controlled to be opened or closed in linkage with the on/off of the compressor in the foregoing embodiment, but a switching time point of the second valve is controlled separately from the on/off of the compressor in the present embodiment.

For example, the second valve 130 may be configured such that the second valve 130 is electrically connected to a valve controller 240 provided separately from the compressor controller 140 to independently control the compressor, and configured to be controlled independently from the drive motor.

The valve controller 240 may check whether or not the drive motor is driven, and control the bypass pipe 120 to be closed when the drive motor is driven, but control the bypass pipe 120 to be opened when the drive motor is stopped.

In other words, according to the foregoing embodiment, the second valve 130 may be opened during the stop of the compressor (more particularly, the drive motor which is a motor drive), namely, while at the same stopping the drive motor, but the valve controller according to the present embodiment may open the bypass pipe 120 for a predetermined period of time subsequent to the stop of the drive motor. Of course, when the bypass pipe 120 is not opened in a state that the compressor 1 is stopped, the suction pressure of the first valve 110 may be larger than the discharge pressure of the first valve 110, and thus may not be quickly closed, and due to this, refrigerant discharged in the direction of the condenser may flow backward in the direction of the compressor. However, when the second valve 130 is connected to an additional valve controller 240, it may be possible to control the refrigerating cycle device in various ways according to the operation condition.

Figure 8:
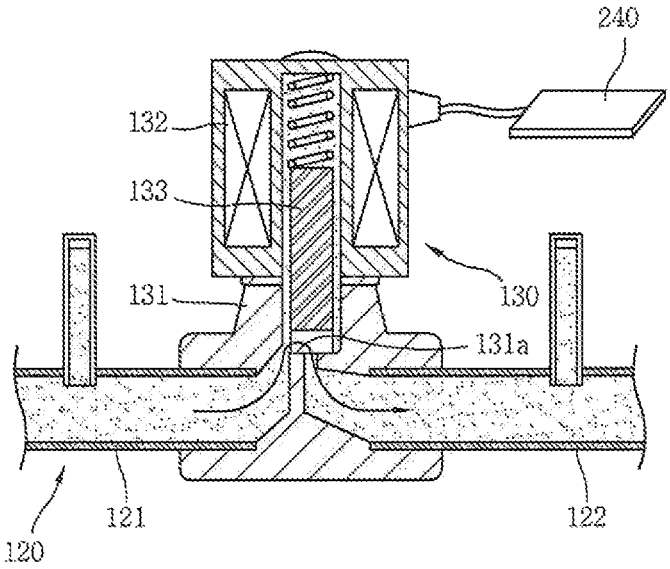
FIGS. 8 and 9 are schematic views illustrating a second valve provided with a valve controller and an example of a rotary compressor to which the second valve is applied in the rotary compressor according to the present disclosure.
Figure 9:
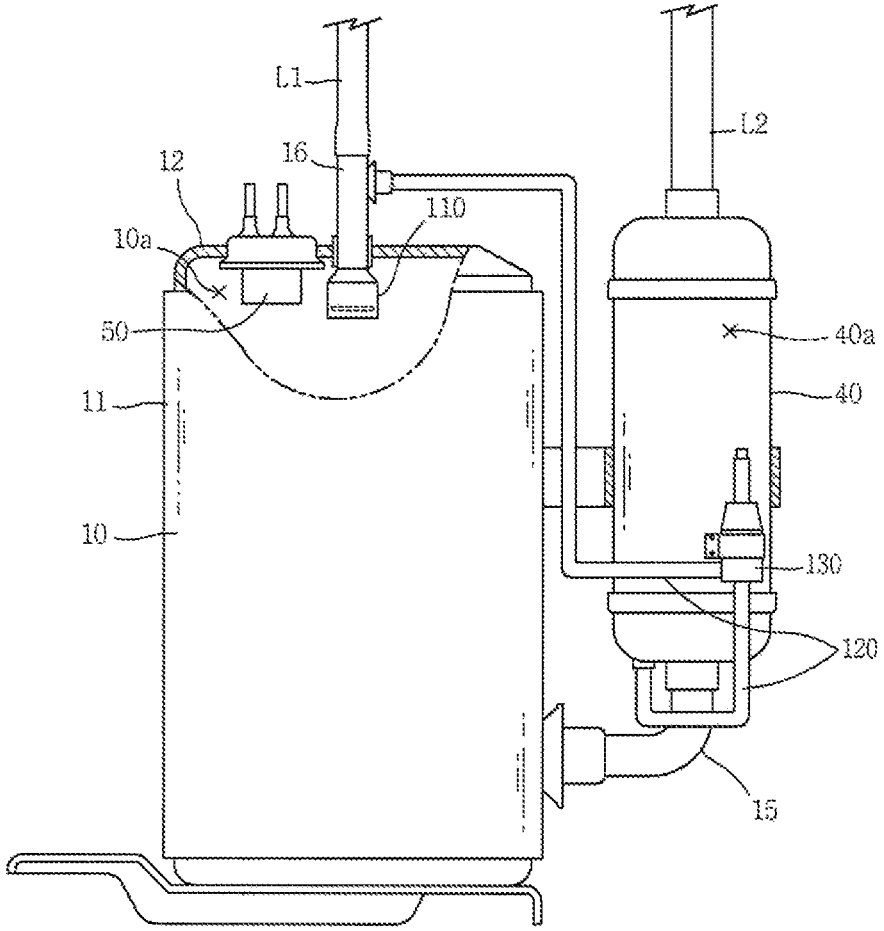

Furthermore, as illustrated in FIG. 9, one end of the bypass pipe 120 may be branched between a discharge side of the first valve 110, namely, an outlet side of the first valve 110, and an inlet of the condenser 2, but in this case, as illustrated in FIG. 8, the second valve 130 may not be directly linked to the compressor 1, and independently controlled from the compressor 1 by the valve controller 240 separately provided therein.

In other words, in this case, as illustrated in the description of FIGS. 1 through 7, the second valve 130 may not be immediately opened when the compressor is stopped, and the second valve 130 may not be immediately closed when the compressor is restarted. It may be configured such that the second valve 130 maintains a closed state for a predetermined period of time even when the compressor 1 is stopped and then is opened just prior to restarting the compressor 1 to allow the suction side and the discharge side of the compressor 1 to instantaneously reach an equilibrium pressure state. As a result, during the differential pressure operation, refrigerant between the first valve 110 and the condenser 2 from flowing into the bypass pipe 120 may be prevented.

Figure 10:
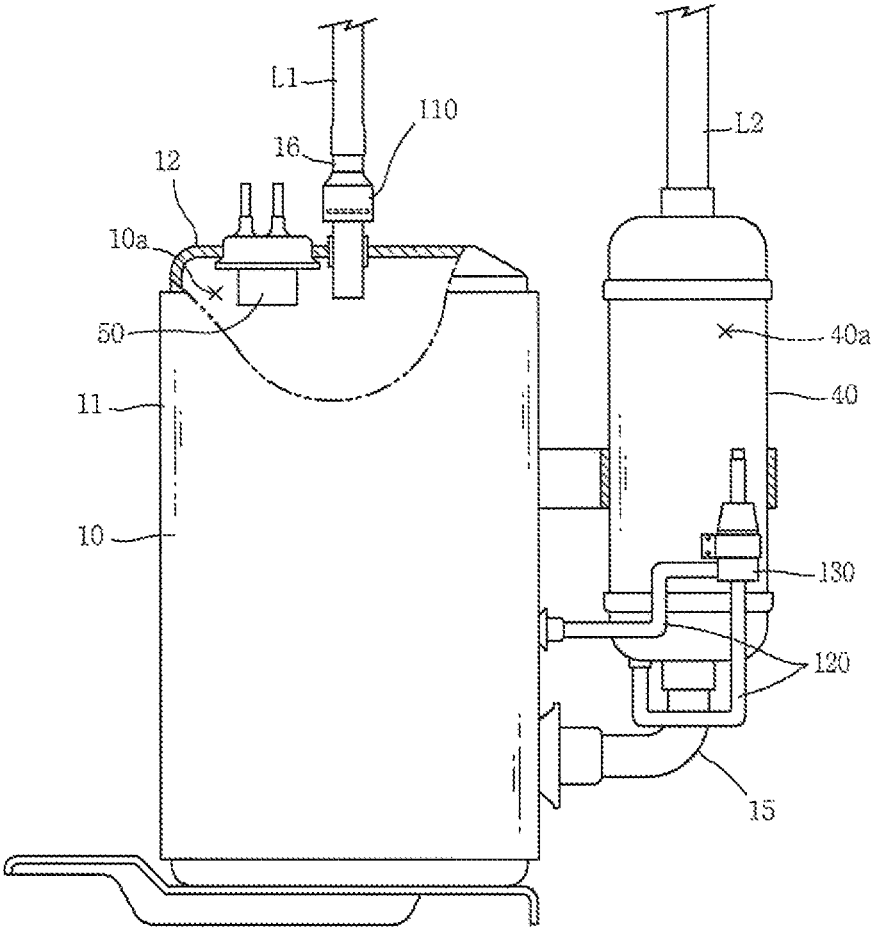
FIGS. 10 and 11 are schematic views illustrating another embodiment for the installation location of a first valve in a refrigerating cycle device according to FIG. 2.
Figure 11:
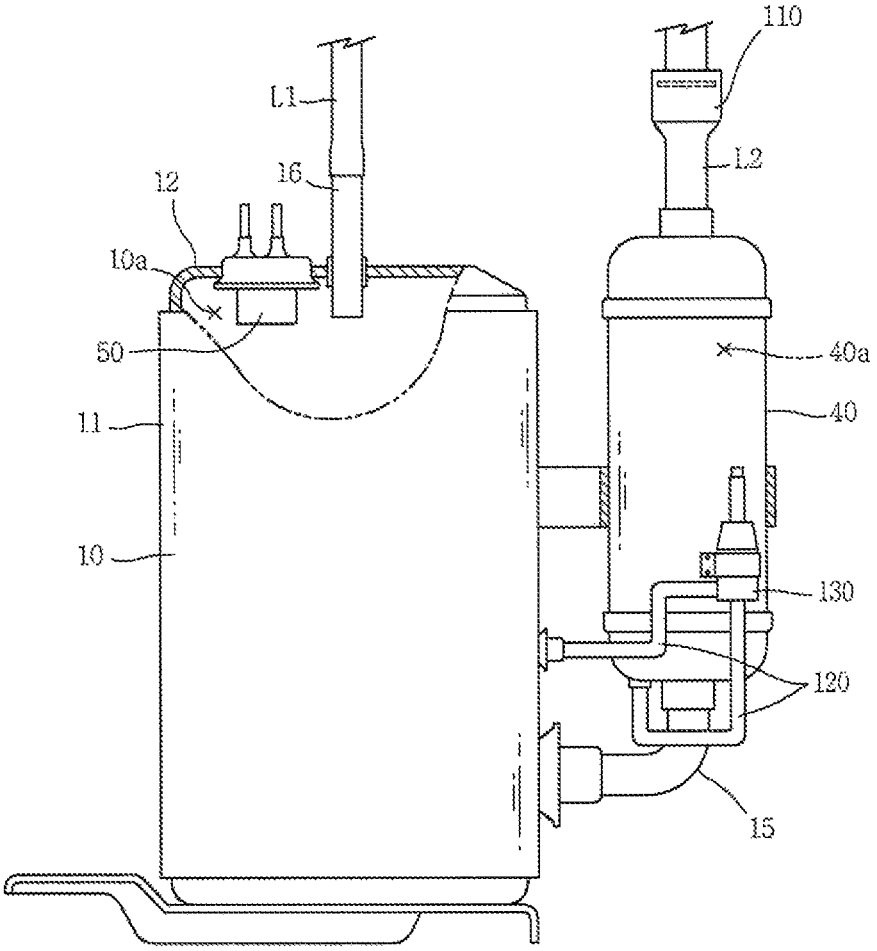

On the other hand, a case where there is another embodiment for the installation location of the first valve in a rotary compressor according to the present disclosure is illustrated in FIGS. 10 and 11.

In other words, the first valve is provided in the inner space 10*a* of the compressor casing in the foregoing embodiment, but the first valve 110 is provided at an outside of the compressor casing 10 in the present embodiment as illustrated in FIG. 10.

As described above, even when the first valve 110 is provided at an outside of the compressor casing 10, the second valve 130 may be provided at the same location as that of the foregoing embodiment, namely, at an upstream side than the first valve 110 based on the discharge order of refrigerant, and the resultant basic configuration and operational effects thereof will be substantially the same as those of the foregoing embodiment, and thus the detailed description thereof will be omitted.

However, in this case, the first valve 110 may be provided at an outside of the casing 10, and thus maintenance for the first valve 110 may be advantageous.

Furthermore, as illustrated in FIG. 11, the first valve 110 may be provided at the suction side refrigerant pipe (L2) connected to an inlet end of the accumulator 40. In this case, even when the second valve 130 maintains a closed state during the stop of the compressor 1, a phenomenon in which the first valve 110 is not opened may be prevented in advance.

On the other hand, a case where there is another embodiment for a location at which the bypass pipe is branched from a rotary compressor according to the present disclosure is illustrated in FIGS. 12 through 16.

Figure 12:
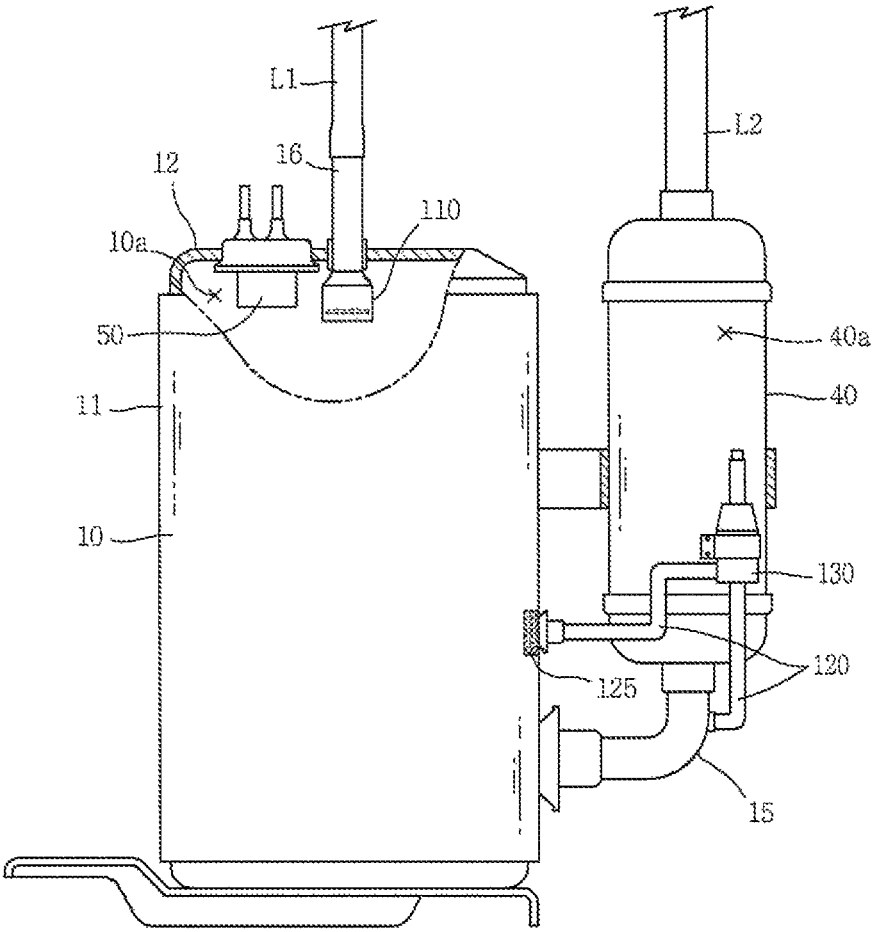
FIGS. 12 through 16 are schematic views illustrating other embodiments for the connection location of a bypass pipe in a refrigerating cycle device according to FIG. 2.

In other words, an outlet end of the bypass pipe is communicated with the inner space of the accumulator in the foregoing embodiment, but an outlet end of the bypass pipe 120 is connected to a suction pipe 15 in the present embodiment as illustrated in FIG. 12.

In this case, as the inner space 10*a* of the casing 10 is directly communicated with the suction pipe 15, a pressure equalization time may be further shortened. However, oil or liquid refrigerant discharged to the inner space 10*a* of the casing 10 may be directly introduced into the compression space 33*a* without passing through the inner space 40*a* of the accumulator 40, and thus an oil separator, a liquid refrigerant separator or the like may be preferably provided at an inlet end of the bypass pipe 120.

Figure 13:
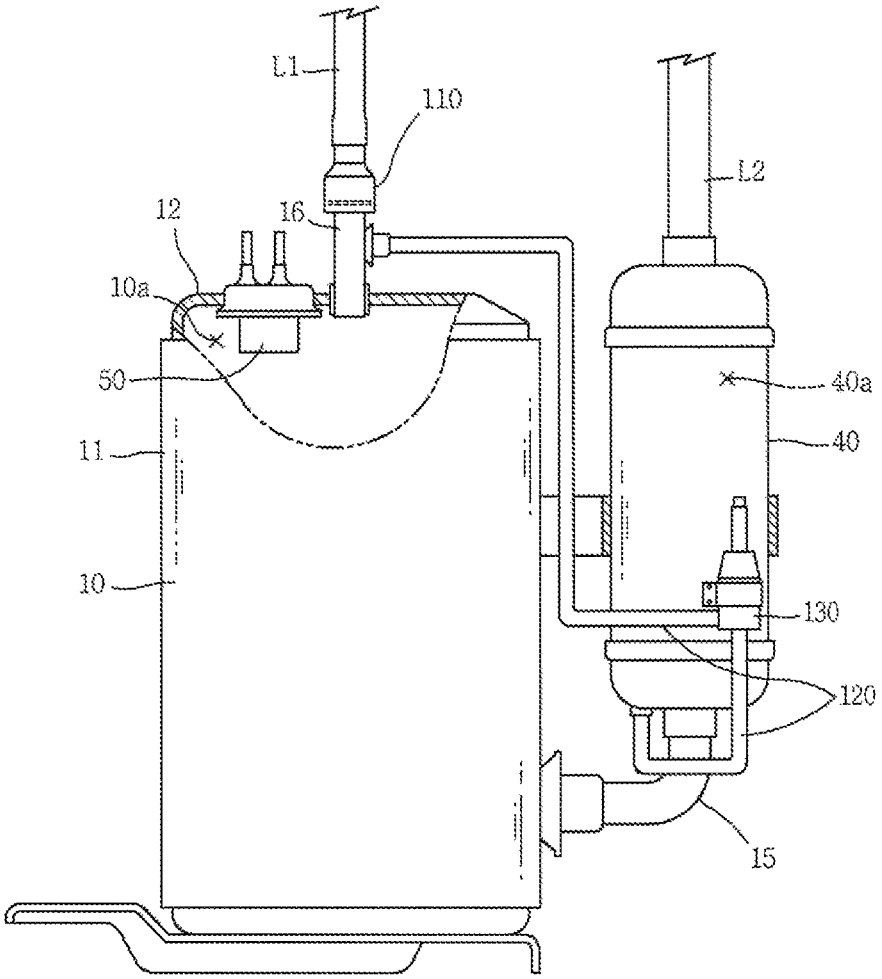

Furthermore, as illustrated in FIG. 13, an inlet end of the bypass pipe 120 may be connected to a discharge pipe 16 from an outside of the compressor casing 10.

In this case, an inlet end of the bypass pipe 120 may be provided at the discharge pipe 16, thereby facilitating a connection work of the bypass pipe 120 compared to communicating the inlet end of the bypass pipe 120 with the compressor casing 10.

Here, the first valve 110 may be preferably provided at an outside of the compressor casing 10, but as illustrated in the embodiment of FIG. 9, the first valve 110 may be provided at an upstream side than the inlet end of the bypass pipe 120, namely, at an inlet end of the discharge pipe 16 in the inner space 10*a* of the compressor casing 10.

Figure 14:
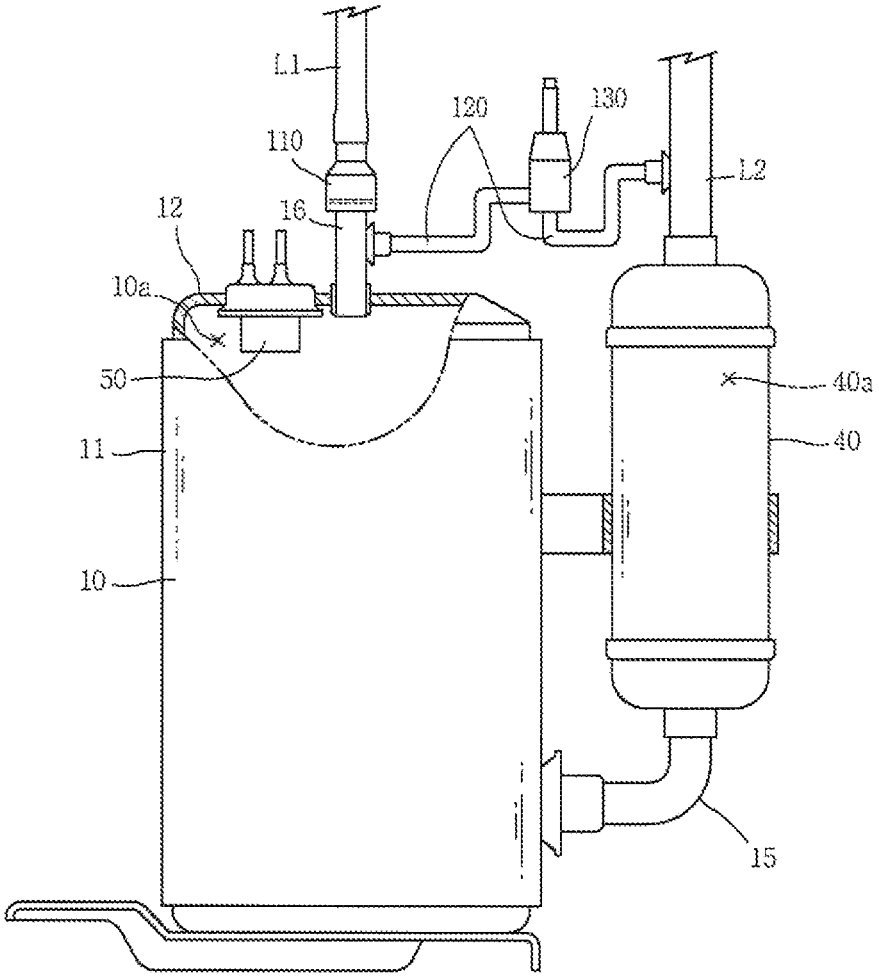
Figure 15:
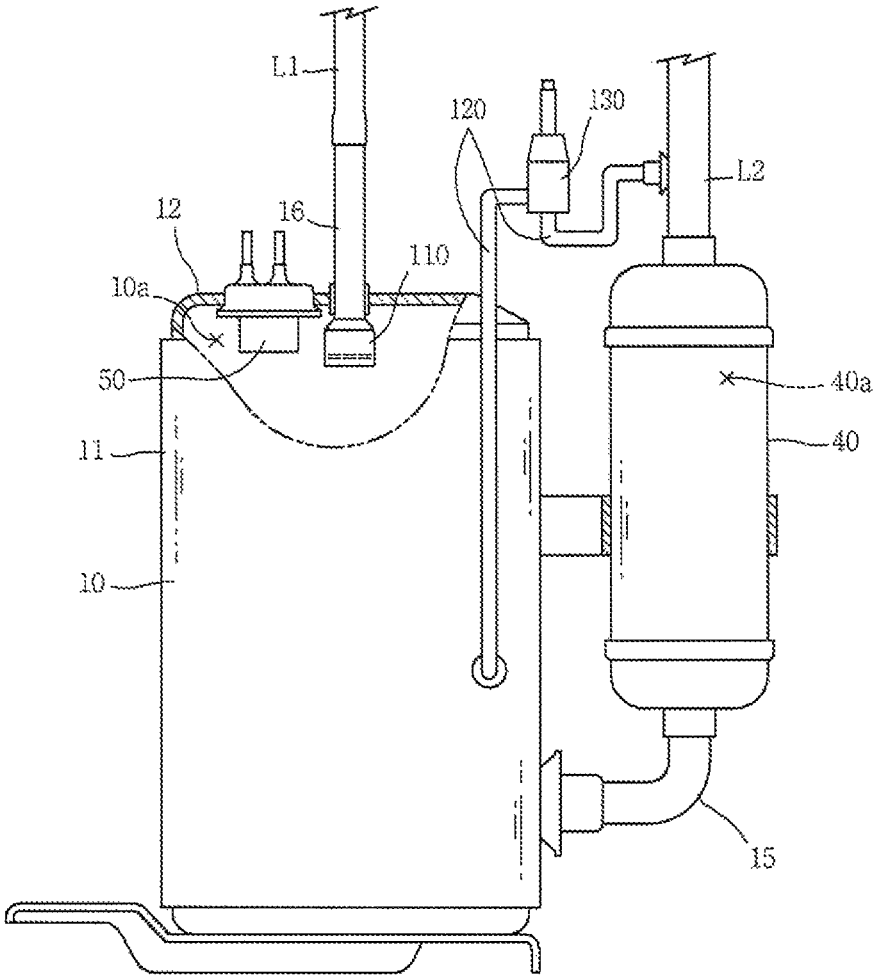

Furthermore, as illustrated in FIG. 14, an outlet end of the bypass pipe 120 may be connected to an inlet side of the accumulator 40, namely, the suction side refrigerant pipe (L2).

In this case, the outlet end of the bypass pipe 120 may be provided at the suction side refrigerant pipe (L2), thereby facilitating a connection work of the bypass pipe to that extent compared to communicating the outlet end of the bypass pipe 120 with the inner space 40*a* of the accumulator 40 as illustrated in FIG. 13.

Here, as illustrated in FIG. 14, the inlet end of the bypass pipe 120 may be provided at the discharge pipe 16, according to circumstances, the inlet end of the bypass pipe 120 may be provided at the inner space 10*a* of the compressor casing 10.

Figure 16:
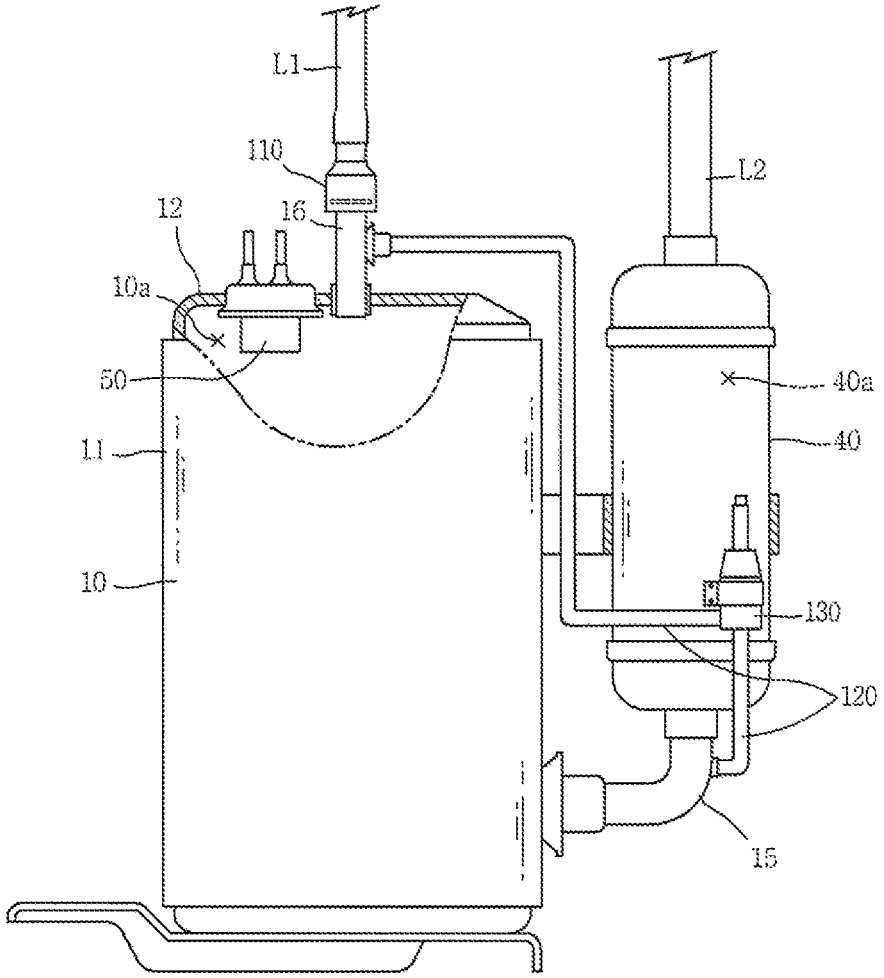

Furthermore, as illustrated in FIG. 16, the outlet end of the bypass pipe 120 may be connected to the suction pipe 15 as illustrated in the embodiment of FIG. 12.

The resultant basic operational effects thereof will be similar to the foregoing case of FIG. 12, and thus the description thereof will be omitted. However, in this case, as the inlet end of the bypass pipe 120 is connected to the discharge pipe 16, oil or liquid refrigerant may be separated from the inner space 10*a* of the compressor casing 10 by a significant amount, thereby effectively suppressing oil or liquid refrigerant from being introduced into the compression space.

On the other hand, although the foregoing embodiment has described that a rotary compressor is merely applicable to only a case of a single operation mode performing only a power operation including stop, according to circumstances, the present disclosure may be also applicable in a similar manner to a case of a multi-operation mode further including an idling operation other than the foregoing embodiment.

For example, if the power operation is a state in which the compressor is driven to generate a pressure load, and stop is a state in which the compressor is off to remove a pressure load, then the idling operation may be a state in which the compressor is driven but not operated to remove a compression load.

Accordingly, when the first valve, the bypass pipe and the second valve disclosed in the foregoing embodiment are applied thereto, it may be possible to form an equilibrium pressure state between the suction side and the discharge side of the compression unit, according to the need even, in case of the idling operation.

Furthermore, meanwhile, the foregoing embodiments have described a rotary compressor as an example, but the present disclosure may be also applicable in a similar manner to all high pressure compressors in which the inner space of the casing is a discharge space, including a twin rotary compressor in which a plurality of cylinders are disposed in an axial direction.

An aspect of the present disclosure is to provide a high pressure compressor and a refrigerating cycle device having the same capable of being quickly restarted when the refrigerating cycle device is off and then reoperated.

Furthermore, another aspect of the present disclosure is to provide a high pressure compressor and a refrigerating cycle device having the same capable of implementing an equilibrium pressure operation for resolving a pressure difference between the suction pressure and the discharge pressure while at the same time stopping the compressor when the refrigerating cycle device is off and then reoperated, thereby quickly restarting the compressor during the reoperation of the refrigerating cycle device.

Furthermore, still another aspect of the present disclosure is to provide a high pressure compressor and a refrigerating cycle device having the same capable of implementing an equilibrium pressure operation for resolving a pressure difference between the suction pressure and the discharge pressure at an appropriate time point when the refrigerating cycle device is off and then reoperated, thereby quickly restarting the compressor during the reoperation of the refrigerating cycle device.

Furthermore, yet still another aspect of the present disclosure is to provide a high pressure compressor and a refrigerating cycle device having the same capable of allowing the refrigerating cycle device to exchange heat in a state that the refrigerating cycle device is off to stop the compressor.

Furthermore, still yet another aspect of the present disclosure is to provide a high pressure compressor and a refrigerating cycle device having the same capable of quickly restarting the compressor during the reoperation of the refrigerating cycle device to prevent the over load protector from being damaged in advance, thereby preventing the motor from being overheated and burned out to enhance the reliability of the compressor.

In order to accomplish the objective of the present disclosure, there is provided a high pressure compressor, including a casing having a sealed inner space; a drive motor provided in the inner space of the casing; a compression unit provided in the inner space of the casing, and provided with a compression space for compressing refrigerant, and provided with a suction port for guiding refrigerant into the compression space, and provided with a discharge port for guiding refrigerant compressed in the compression space into the inner space of the casing; a discharge valve provided in the compression unit to selectively open or close the discharge port according to a difference between a pressure of the inner space of the casing and a pressure of the compression space of the compression unit; a first valve configured to suppress refrigerant discharged from the inner space of the casing from flowing backward into the inner space of the casing; a bypass pipe connected between a discharge side and a suction side of the compression unit based on the compression unit; and a second valve provided at the bypass pipe to selectively open or close the bypass pipe.

Here, the second valve may close the bypass pipe when a compression load occurs on the compression unit but open the bypass pipe when a compression load is removed from the compression unit.

Furthermore, the second valve may be electrically connected to a controller for controlling the drive motor to close the bypass pipe during the operation of the drive motor but open the bypass pipe during the stop of the drive motor.

Furthermore, the second valve may open the bypass pipe while at the same time stopping the drive motor.

Furthermore, the second valve may close the bypass pipe while at the same time restarting the drive motor.

Furthermore, the controller may check the switching state of the second valve prior to restarting the drive motor.

Furthermore, the controller may check the switching state of the second valve, and then delay the restart of the drive motor when a pressure difference between the suction side and the discharge side based on the compression unit is above a reference value.

Furthermore, the second valve may be electrically connected to a valve controller for controlling the second valve, and independently controlled from the drive motor.

Furthermore, the valve controller may check whether or not the drive motor is driven, and close the bypass pipe when the drive motor is driven but open the bypass pipe when the drive motor is stopped.

Furthermore, the valve controller may open the bypass pipe subsequent to the stop of the drive motor.

Furthermore, a first end portion of the bypass pipe may communicate between the discharge valve and the first valve, and a second end portion of the bypass pipe may communicate between the first valve and the suction port of the compression unit.

Furthermore, the first end portion of the bypass pipe may communicate with the inner space of the casing or a discharge pipe which is communicated with the inner space of the casing.

Furthermore, an accumulator provided with an inner space, the inner space of which communicates with the suction port of the compression unit, may be provided at one side of the casing, and the second end portion of the bypass pipe may communicate with the inner space of the accumulator.

In order to accomplish the objective of the present disclosure, there is provided a high pressure compressor, including a casing, an inner space of which constitutes a high pressure unit and is provided with a compression unit; a first refrigerant passage connected between a suction side and a discharge side based on the compression unit; a check valve provided at the first refrigerant passage; a second refrigerant passage branched from the first refrigerant passage to shorten a distance between an inlet of the first refrigerant passage connected to the suction side of the compression unit and an outlet of the first refrigerant passage connected to the discharge side of the compression unit based on the compression unit; a solenoid valve provided at the second refrigerant passage to selectively open or close the second refrigerant passage; and a controller configured to control the solenoid valve to close the second refrigerant passage when a compression load occurs on the compression unit but control the solenoid valve to open the second refrigerant passage when a compression load is removed from the compression unit.

Here, a first end portion of the second refrigerant passage may be branched between the compression unit and the check valve.

Furthermore, the controller may control the solenoid valve to open the second refrigerant passage while at the same time removing a compression load from the compression unit.

Furthermore, the controller may control the solenoid valve to open the second refrigerant passage for a predetermined period of time prior to the occurrence of a compression load on the compression unit.

In order to accomplish the objective of the present disclosure, there is provided a refrigerating cycle device, including a compressor; a condenser connected to the compressor; a condenser fan provided at one side of the condenser; an evaporator connected to the condenser, and an evaporator fan provided at one side of the evaporator, wherein the compressor includes a casing having a sealed inner space, the inner space of which communicates with a discharge pipe; a drive motor provided in the inner space of the casing; a compression unit provided in the inner space of the casing, and provided with a compression space for compressing refrigerant, and provided with a suction port for guiding refrigerant into the compression space, and provided with a discharge port for guiding refrigerant compressed in the compression space into the inner space of the casing; a discharge valve provided in the compression unit to selectively open or close the discharge port according to a difference between a pressure of the inner space of the casing and a pressure of the compression space of the compression unit; a first valve configured to suppress refrigerant discharged from the inner space of the casing from flowing backward into the inner space of the casing; a bypass pipe connected between a discharge side and a suction side of the compression unit based on the compression unit; and a second valve provided at the bypass pipe to selectively open or close the bypass pipe.

Here, the refrigerating cycle device may further include a controller configured to open or close the second valve, wherein the controller controls the second valve to be closed when the drive motor is being driven, and controls the second valve to be opened when the drive motor is stopped so as to allow the suction side and discharge side of the compression unit to form an equilibrium pressure.

Furthermore, the controller may control at least one of the condenser fan and the evaporator fan to be operated in a state that the second valve is open.

Consequently, a high pressure compressor according to the present disclosure and a refrigerating cycle device to which the high pressure compressor is applied may provide a check valve for blocking refrigerant discharged from the compressor toward the condenser from flowing backward again to the compressor as well as provide a bypass pipe for allowing part of refrigerant discharged from the compression unit into the inner space of the casing to be bypassed to the suction side of the compression unit and a solenoid valve for selectively opening or closing the bypass pipe to allow the suction side and the discharge side to quickly form an equilibrium pressure state based on the compression unit when a high pressure compressor such as a rotary compressor is temporarily stopped in the refrigerating cycle device to which the high pressure compressor is applied, thereby quickly restarting the compressor during the reoperation of the refrigerating cycle device.

Through this, even when the compressor is stopped, a so-called differential pressure operation for operating a fan in the refrigerating cycle device may continue for the stopped time period, thereby enhancing energy efficiency. As well, the damage of the over load protector and the motor that can occur when the restart of the compressor is not efficiently carried out during the reoperation subsequent to the stop of the refrigerating cycle device may be prevented in advance, thereby enhancing the reliability of the compressor.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A high pressure compressor, comprising:

a casing having a sealed inner space, the inner space communicating with a discharge pipe;

a drive motor provided in the inner space of the casing;

a compression unit provided in the inner space of the casing, and provided with a compression space that compresses refrigerant, a suction port that guides refrigerant into the compression space, and a discharge port that guides refrigerant compressed in the compression space into the inner space of the casing;

a discharge valve provided in the compression unit to selectively open or close the discharge port according to a difference between a pressure of the inner space of the casing and a pressure of the compression space of the compression unit;

a discharge muffler disposed between the drive motor and the compression unit, and coupled to one side of the compression unit to accommodate the discharge valve;

a first valve provided at the discharge pipe, the first valve configured to suppress refrigerant discharged from the inner space of the casing from flowing backward into the inner space of the casing;

a bypass pipe connected between a discharge side and a suction side of the compression unit based on the compression unit, wherein a first end of the bypass pipe communicates with the inner space of the casing so as to provide communication between the discharge valve and the first valve, and wherein the inner space is positioned outside of the discharged muffler; and a second valve configured to be switched on/off in association with whether the motor is driven, and provided at the bypass pipe to selectively open or close the bypass pipe so as to resolve a pressure difference between the suction side and the discharge side based on the compression unit when the drive motor is stopped, wherein the second valve is electrically connected to a controller, that controls the drive motor to close the bypass pipe during operation of the drive motor but open the bypass pipe when the drive motor is stopped, wherein the controller checks a switching state of the second valve prior to restarting the drive motor so as to prevent the restart of the drive motor prior to closing the second valve, and wherein the controller checks the switching state of the second valve, and then delays the restart of the drive motor when a pressure difference between the suction side and the discharge side based on the compression unit is above a reference value.

2. The high pressure compressor of claim 1, wherein the second valve closes the bypass pipe when a compression load occurs on the compression unit but opens the bypass pipe when the compression load is removed from the compression unit.

3. The high pressure compressor of claim 1, wherein the second valve opens the bypass pipe at the same time the drive motor is stopped.

4. The high pressure compressor of claim 1, wherein the second valve closes the bypass pipe at the same time that the drive motor is restarted.

5. The high pressure compressor of claim 1, wherein a second end of the bypass pipe provides communication between the first valve and the suction port of the compression unit.

6. The high pressure compressor of claim 1, wherein an accumulator provided with an inner space, the inner space communicating with the suction port of the compression unit, is provided at one side of the casing, and wherein the second end of the bypass pipe provides communication between the inner space of the accumulator and the suction port of the compression unit.

7. A high pressure compressor, comprising:

a casing having a sealed inner space, the inner space communicating with a discharge pipe;

a drive motor provided in the inner space of the casing;

a compression unit provided in the inner space of the casing, and provided with a compression space that compresses refrigerant, a suction port that guides refrigerant into the compression space, and a discharge port that guides refrigerant compressed in the compression space into the inner space of the casing;

a discharge valve provided in the compression unit to selectively open or close the discharge port according to a difference between a pressure of the inner space of the casing and a pressure of the compression space of the compression unit;

a discharge muffler disposed between the drive motor and the compression unit, and coupled to one side of the compression unit to accommodate to receive the discharge valve;

an accumulator provided on one side of the casing and having an inner space that communicates with the compression space through a suction pipe;

a first valve provided at the discharge pipe, the first valve configured to suppress refrigerant discharged from the inner space of the casing from flowing backward into the inner space of the casing;

a bypass pipe connected between a discharge side and a suction side of the compression unit based on the compression unit, wherein a first end of the bypass pipe communicates with the inner pace of the casing and a second end of the bypass pipe provides communication between the inner space of the accumulator and the suction port of the compression unit, and wherein the inner space is positioned outside of the discharged muffler;

a second valve configured to be switched on/off in association with whether the motor is driven, and provided at the bypass pipe to selectively open or close the bypass pipe; and a controller configured to open or close the second valve, wherein the controller controls the second valve to be closed when the drive motor is being driven, and controls the second valve to be opened when the drive motor is stopped so as to allow the pressure of the inner space of the casing and the pressure of the compression space to form an equilibrium pressure, and wherein the second valve is electrically connected to the controller, which controls the drive motor, to close the bypass pipe during operation of the drive motor but open the bypass pipe during a stop of the drive motor, wherein the controller checks a switching state of the second valve prior to restarting the drive motor so as to prevent the restart of the drive motor prior to closing the second valve, and wherein the controller checks the switching state of the second valve, and then delays the restart of the drive motor when a pressure difference between the suction side and the discharge side based on the compression unit is above a reference value.

8. The high pressure compressor of claim 7, wherein the first end of the bypass pipe provides communication between the discharge valve and the discharge pipe.

9. The pressure compressor of claim 7, wherein the second end of the bypass pipe communicates with the suction pipe.

10. The high pressure compressor of claim 7, wherein the second valve opens the bypass pipe while at a same time stopping the drive motor.

11. The high pressure compressor of claim 7, wherein the second valve closes the bypass pipe while at a same time restarting the drive motor.

* * * * *